US005335858A

United States Patent [19]

Dunning et al.

[11] Patent Number: 5,335,858

[45] Date of Patent: Aug. 9, 1994

[54] PUMP SPRAYER HAVING LEAK PREVENTING SEALS AND CLOSURES

[76] Inventors: Walter B. Dunning, 21199 Christopher Cir., Sonora, Calif. 95370; Robert L. Bundschuh, 6534 Miami Lakes Dr., Miami Lakes, Fla. 33014

[21] Appl. No.: 47,149

[22] Filed: Apr. 14, 1993

[51] Int. Cl.[5] ..... B05B 9/043

[52] U.S. Cl. ..... 239/333; 239/349; 239/375; 222/321; 222/383

[58] Field of Search ..... 239/333, 343, 349, 375, 239/428.5; 222/321, 383, 380; 417/550, 555.1

[56] References Cited

U.S. PATENT DOCUMENTS

| | | | |
|---|---|---|---|
| 2,521,961 | 9/1950 | Bacheller | 222/321 |
| 2,545,682 | 12/1970 | Beard | 239/469 |
| 2,657,834 | 11/1953 | Bacheller | 222/321 |
| 3,913,841 | 10/1975 | Tada | 239/321 |
| 4,071,172 | 1/1978 | Balogh | 222/321 |
| 4,120,430 | 10/1978 | French | 222/324 |
| 4,141,475 | 2/1979 | Nilson | 222/494 |
| 4,161,288 | 7/1979 | McKinney | 239/333 |
| 4,227,650 | 10/1980 | McKinney | 239/333 |
| 4,234,128 | 11/1980 | Quinn et al. | 239/478 |
| 4,402,432 | 9/1983 | Corsette | 222/321 |
| 4,452,379 | 6/1984 | Bundschuh | 222/207 |
| 4,474,314 | 10/1984 | Roggenburg, Jr. | 222/494 |
| 4,479,593 | 10/1984 | Bundschuh | 222/321 |
| 4,538,745 | 9/1985 | Dunning et al. | 222/153 |
| 4,598,862 | 7/1986 | Rice | 239/343 X |
| 4,640,444 | 2/1987 | Bundschuh | 222/321 |
| 4,646,973 | 3/1987 | Focaracci | 239/343 X |
| 4,781,311 | 11/1988 | Dunning et al. | 222/153 |
| 4,925,106 | 5/1990 | Maas et al. | 239/343 X |
| 4,971,252 | 11/1990 | Tasaka et al. | 239/343 X |
| 4,991,747 | 2/1991 | Van Brocklin | 239/333 X |
| 5,054,659 | 10/1991 | Micallef | 222/321 |
| 5,088,629 | 2/1992 | O'Neill | 239/333 X |
| 5,156,307 | 10/1992 | Callahan et al. | 239/343 X |
| 5,222,637 | 6/1993 | Giuffredi | 239/333 X |

*Primary Examiner*—Andres Kashnikow
*Assistant Examiner*—Lesley D. Morris
*Attorney, Agent, or Firm*—Delbert J. Bernard

[57] ABSTRACT

A spring (304) biases a movable housing part (12, 16) away from a fixed housing part (10, 306, 156). The fixed housing part (10, 306, 156) is composed only a main housing (10), a draw tube (306) and an inlet valve housing (156). The inlet valve housing (156) is inserted into the main housing (10). The movable housing part (12, 16) is composed of a forward housing (12), which includes a trigger (14), and a nozzle (16). The main housing (10), the inlet valve housing (156) and the forward housing (12) together form a variable volume pump chamber (318). The inlet valve (184, 268) includes , a valve plug (184) which is initially connected to a sidewall portion (168) of the inlet valve housing (156) by a frangible section (196). During assembly, an axial push is imposed on the valve plug (184), to sever the frangible section (196), and then move the valve plug (184) rearwardly past stop lugs (198, 200), into a position axially between the stop lugs (198, 200) and an inlet valve seat (268). The nozzle (16) is rotatable between an "open" position in which two sections (64, 97) of an outlet passageway are in alignment, to permit liquid flow from the pump chamber (318) to an outlet opening (46) and a "closed" position in which the two passageway sections (64, 97) are out of alignment, and flow out from the pump chamber (318) is blocked.

40 Claims, 21 Drawing Sheets

15
16
17
18
156
158
160
162
163
164
166
167
168
170
172
174
176
178
180
182
184
186
187
188
190
192
194
196
198
200
202
204
206
208
210

PUMP SPRAYER HAVING LEAK PREVENTING SEALS AND CLOSURES

DESCRIPTION

1. Technical Field

This invention relates to manually operable liquid sprayers. In particular, it relates to the provision of an improved liquid sprayer that is relatively easy to manufacture and assemble and which includes effective seals and closures for preventing leakage during shipment and storage.

2. Background of the Invention

A common type of liquid sprayer or dispenser comprises a fixed housing part that is connectable to a container of a liquid to be dispensed, and a movable housing part which together with the fixed housing part forms a variable volume pump chamber between them. A spring normally biases the movable housing part away from the fixed housing part. A trigger on the movable housing part is pulled to move the movable housing part towards the fixed housing part, in opposition to the spring force. A pull on the trigger decreases the volume of the pump chamber, and closes the inlet valve, and opens the outlet valve, and forces liquid out from the pump chamber through an outlet opening. A release of the trigger allows the spring to move the movable housing part forwardly. This increases the volume of the pump chamber, and closes the outlet valve, and opens the inlet valve, and draws liquid from the container into the pump chamber. Liquid dispensers of this type are quite well-known and many different constructions of these dispensers exist in the prior art.

Problems inherent with the prior art liquid dispensers include a structural complexity which makes the dispenser relatively costly to manufacture, and leakage during shipment and storage. It is an object of the present invention to provide a liquid dispenser that has a minimum number of parts, each of which is relatively inexpensive to manufacture, and a construction enabling relatively easy and economic assembly of the parts. It is also an object of the present invention to provide an improved seal system which is also simple in construction, and permits an economical assembly, but which is quite effective in the prevention of unwanted leakage from the container to which it is attached, both during shipment and storage.

Liquid dispensers in the patent literature are shown by the following U.S. Pat. No.: 3,545,682, granted Dec. 8, 1970, to Walter C. Beard; No. 3,913,841, granted Oct. 21, 1975, to Tetsuya Tada; No. 4,120,430, granted Oct. 17, 1978, to Floyd R. French; No. 4,141,475, granted Feb. 27, 1979 to Billy N. Nilson; No. 4,234,128, granted Nov. 18, 1980, to David R. Quinn and Walter H. Wesner; No. 4,402,432, granted Sep. 6, 1983 to Douglas F. Corsette; No. 4,452,379, granted Jun. 5, 1984, to Robert L. Bundschub; No. 4,474,314, granted Oct. 2, 1984 to Stanley L. Roggenburg; No. 4,479,593, granted Oct. 30, 1984, to Robert L. Bundschuh; No. 4,538,745, granted Sep. 3, 1985, to Walter B. Dunning and Robert L. Bundschuh; No. 4,640,444, granted Feb. 3, 1987 to Robert L. Bundschub; and No. 4,781,311, granted Nov. 1, 1988, to Walter B. Dunning, George E. Campbell and Julio Focaracci. Each of these patents should be carefully considered for the purpose of putting the present invention into proper perspective relative to the prior art.

In preferred form, the liquid dispensers of the present invention are linear trigger sprayers, of the general type disclosed by the aforementioned U.S. Pat. Nos. 4,120,430; 4,452,379; 4,479,593; 4,538,745; 4,640,444 and 4,781,311. Dispensers of the present invention may utilize interference fit internal seals, such as seal 60 shown by U.S. Pat. No. 4,538,745, and may include a trigger actuated member, like finger 71 in U.S. Pat. No. 4,538,745, for unseating a seal Liquid dispensers of the present invention may utilize some housing construction and assembly features which are similar to features disclosed in U.S. Pat. Nos. 4,452,379; 4,479,593; 4,538,745; and 4,640,444. Liquid dispensers of the present invention may also utilize outlet valves similar to the outlet valves disclosed in U.S. Pat. Nos. 3,545,682 and 4,141,475. According to an aspect of the invention, an outlet valve of this type is combined with an off/on valve, similar to the off-on valve disclosed in U.S. Pat. No. 4,234,128, to provide a very effective closure at the outlet end of the sprayer. Liquid dispensers of the present invention may further utilize a pump chamber volume reducing feature that is dislcosed by U.S. Pat. No. 3,913,841.

SUMMARY OF THE INVENTION

The liquid sprayer of the present invention is basically characterized by a fixed housing part and a movable housing part which together define a variable volume chamber between them. The fixed housing part includes a liquid inlet passageway for delivering liquid from a reservoir into the pump chamber, and an inlet valve. The movable housing part includes a spray forming outlet opening and an outlet valve between the pump chamber and the outlet opening. Movement of the movable housing part towards the fixed housing part decreases the volume of the pump chamber, and closes the inlet valve, and opens the outlet valve, and forces liquid out from the pump chamber through the spray forming outlet. Movement of the movable housing part away from the fixed housing part increases the volume of the pump chamber, and closes the outlet valve, and opens the inlet valve, and draws liquid through the inlet passageway into the pump chamber.

According to an aspect of the invention, the inlet passageway includes a valve plug socket which opens towards the pump chamber. This socket includes an annular base and an annular inlet valve seat at the base. The inlet valve includes the inlet valve seat and an axially elongated valve plug. The valve plug has a closed, first end directed towards the inlet valve seat. It also includes an opposite, second end, having an endwall. The fixed housing part includes a valve plug stop which is spaced axially from the inlet valve seat and confronts the second end of the valve plug. When the inlet valve is closed, the closure end of the valve plug is against the inlet valve seat and the second end of the valve plug is spaced axially from the valve plug stop. When the inlet valve is opened, the second end of the valve plug is against the valve plug stop, and the closure end portion of the valve plug is spaced axially from the inlet valve seat, and a liquid flow path is formed through the valve plug socket, around the valve plug. Liquid flows through this flow path into the pump chamber.

In preferred form, the movable housing part includes an outlet member having an axial outlet opening surrounded by an annular outlet valve seat. The outlet valve includes this outlet valve seat and a pin that is positioned axially inwardly of the outlet opening. The pin includes a closure surface which confronts the outlet valve seat. The outlet member is resilient and has a static first position in which the outlet valve seat is contiguous the closure surface on the pin. Contact between the outlet valve seat and the closure surface on the pin closes the outlet opening and constitutes the closed position of the outlet valve. The outlet member is movable by fluid pressure in the pump chamber, axially away from the pin, into an open position in which the outlet valve seat is spaced from the closure surface on the pin. In this position a fluid passageway is formed by and between the outlet valve seat and the closure surface. In preferred form, the outlet member includes an annular wall projecting axially rearwardly, into a position surrounding the pin. The outlet member and the pin together define a swirl chamber. The movable housing part includes at least one inlet passageway leading from the pump chamber generally tangentially into the swirl chamber.

According to another aspect of the invention, the fixed housing part includes a tubular inlet valve housing that includes an open interior, front and rear ends, and radially inwardly directed stop lugs intermediate its ends. The inlet valve housing is formed to initially include a valve plug located forwardly of the stop lugs. The valve plug has a closure end facing rearwardly, and a second, forwardly facing opposite end. A frangible section initially connects the valve plug to the tubular inlet valve housing. This frangible section is breakable in response to a push on the valve plug. During assembly of the liquid sprayer, the tubular inlet valve housing is inserted into a main housing portion of the fixed housing part. During this assembly the severed valve plug is moved axially rearwardly through the tubular inlet housing, first to and then beyond the stop lugs, into a position rearwardly of the stop lugs, between the stop lugs and the inlet valve seat. In the preferred embodiment, the fixed housing part has an inlet region which includes a forwardly facing, inlet valve seat surrounding the liquid inlet passageway. The movable housing section comprises an elongated tubular sidewall forming a pump chamber sidewall, and a forward part forming a pump chamber front wall. A seal seals between the inlet region and the pump chamber sidewall. This seal constitutes a main rear end closure for the pump chamber. The movable housing part also includes a flex wall section connected to the outlet member. This flex wall section normally holds the outlet valve seat contiguous the closure member on the pin. The flex wall section permits axial movement of the outlet member forwardly away from the pin, to create a liquid passage between the outlet valve seat and the closure surface on the pin. The movable housing part includes an outlet passageway which leads from the pump chamber to a region adjacent the outlet valve seat, the closure surface, and the flex wall section. Movement of the movable housing part towards the fixed housing part, when liquid is in the pump chamber, will move the valve plug into a seated position on the inlet valve seat. It will also force liquid out from the pump chamber through the outlet passageway to the flex wall section. This liquid will exert pressure on the flex wall section and force the outlet member forwardly, thereby moving the outlet valve seat away from the closure surface on the pin and permitting liquid flow from the outlet passageway through a space between the outlet valve seat and the closure surface on the pin, to and through the outlet opening. A forward movement of the movable housing part away from the fixed housing part will cause a rearward movement of the flex wall section and the outlet member, to place the outlet valve seat against the closure surface on the pin, and will move the valve plug forwardly from the inlet valve seat, into a position against the stop lugs. In this position of the valve plug, liquid flows through the liquid inlet passageway, around the valve plug, into the pump chamber.

In preferred form, the movable housing part includes a pump chamber space outwardly bounded by the pump chamber sidewall. The fixed housing part includes a tubular portion which projects into the chamber space when the movable housing part is moved towards the fixed housing part. This entry of the tubular portion into the chamber space substantially decreases the volume of the chamber space.

Also in preferred form, the movable housing part includes an axial member projecting rearwardly from the pump chamber front wall. The chamber space is annular and is formed by and radially between the pump chamber sidewall and the axial member. When the movable housing part is moved towards the fixed housing part the tubular portion of the fixed housing part extends relatively into this annular chamber. Also, the axial member extends relatively into the tubular portion of the fixed housing part. Thus, when the movable housing part is moved the full extent of its movement towards the fixed housing part, the volume of the pump chamber is made minimal. As a result, liquid within the chamber is dispensed efficiently at high pressure. Also, during expansion of the pump chamber, liquid flow into the pump chamber is fast and positive and substantially fills the pump chamber.

In preferred form, the movable housing part includes a nozzle which includes the outlet member, the outlet opening and the flex wall. This nozzle is rotatable between "open" and "closed" positions. The movable housing part includes a two section outlet passageway, leading from the pump chamber to the outlet valve. One section of this passageway is formed in the nozzle. The other section is formed in a wall of the pump chamber. When the nozzle is rotated into its "open" position, the two passageway sections are in alignment, and liquid can flow from the pump chamber to the outlet valve. When the nozzle is rotated into its closed position, the two sections of the outlet passageway are out of alignment and flow through the outlet passageway is blocked.

The preferred embodiment is composed from six components. These components are assembled to form a fixed housing part and a movable housing part. The movable housing part is constructed from two components, each of which is injected-molded. These components are a nozzle and a member which together with the nozzle forms an outlet valve, and which includes an endwall and a tubular sidewall portion of a pump chamber, and a trigger. The fixed housing part is constructed from three components. These are a main housing which is attachable to the neck of a bottle containing a liquid to be sprayed, a draw tube which extends downwardly from an inlet passage in the main housing into liquid in the bottle, and an inlet valve housing which is assembled into a portion of the main housing. The sixth component is a spring which is positioned between the movable and fixed housing parts. the nozzle is rotatable between OFF and OPEN positions. It cooperates with the trigger component to provide a shipping seal. The trigger component provides the front wall and a tubular sidewall of the pump chamber, an outlet passageway leading out from the pump chamber to an outlet opening that is a part of the nozzle, a trigger adapted to be grasped by two fingers of a user, and a vent seal opening member. The main housing has a base adapted for attachment to a bottle. The socket for receiving the upper end of the dip tube, and inlet passageway extending from this socket to an inlet valve seat. The inlet valve housing has a rear portion which connects to the main housing, about the inlet passageway. The inlet valve housing includes a vent seal at its rear end and a second seal which seals between the inlet valve housing and the tubular sidewall of the pump chamber. The main housing and the inlet valve housing are both formed from plastic by injection molding. The inlet valve housing is formed to include a valve plug that is initially connected to the body of such housing by a frangible section. During assembly, an endwise push is applied onto the valve plug which severs the frangible section and moves the valve plug rearwardly, into a position axially between the inlet valve housing and stop lugs which are a part of the inlet valve housing. The draw tube provides a flow path for liquid from the bottle to the inlet end of the inlet passageway. The spring biases the movable housing part away from the fixed housing part. It is believed that the various components of the liquid dispenser can be easily and quickly machine assembled. The structural features of the six components which permit such assembly are a part of the invention. However, the machine assembly process is not a part of the invention.

Other objects, features and advantages of the present invention are hereinafter set forth in the detailed description of the best mode and other disclosed embodiments.

BRIEF DESCRIPTION OF THE DRAWINGS

Like reference numerals are used to designate like parts throughout the several views of the drawing, and.

Figure 1:
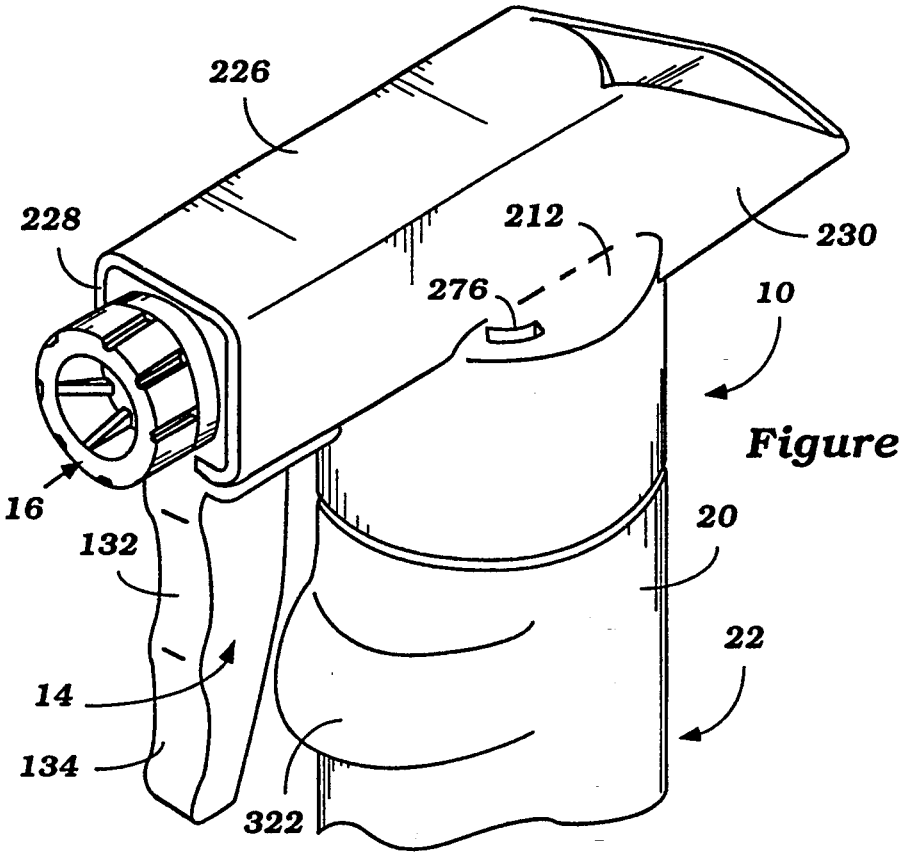
FIG. 1 is a pictorial view of a trigger sprayer embodying the present invention, shown secured to a top portion of a bottle containing a liquid to be sprayed, such view being taken from above and looking towards the top, the front and one side of the trigger sprayer.
Figure 2:
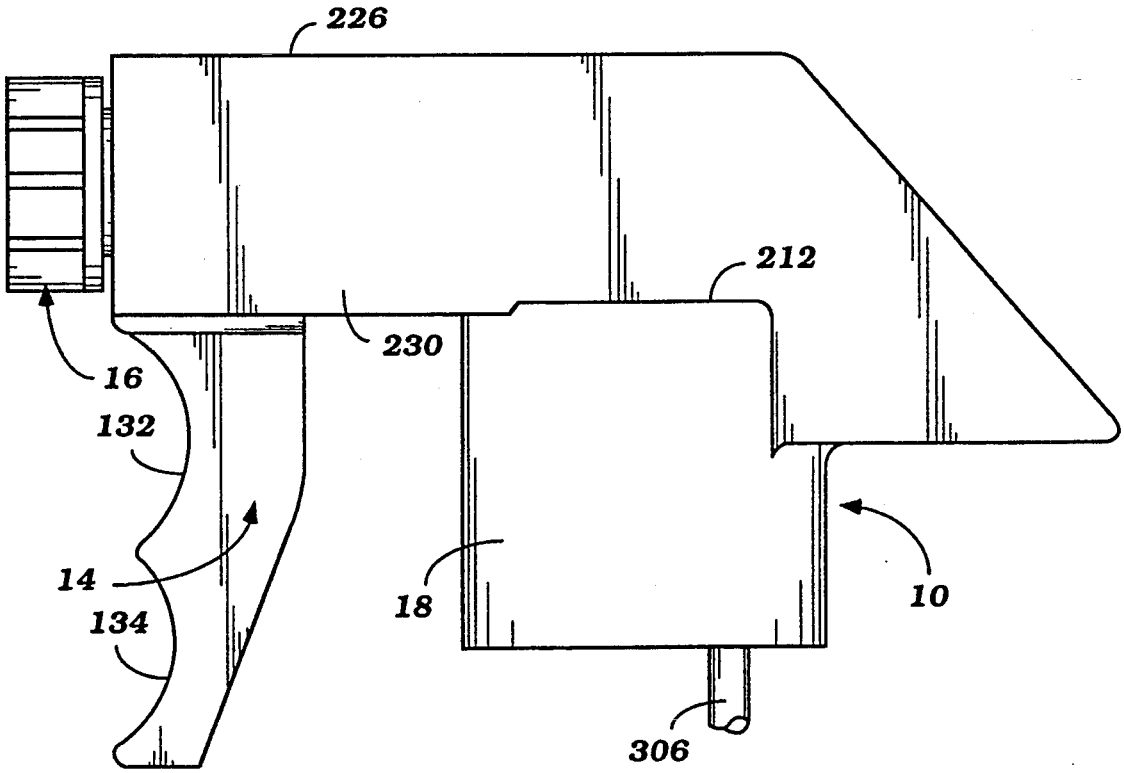
FIG. 2 is a side elevational view of the trigger sprayer shown in FIG. 1.
Figure 3:
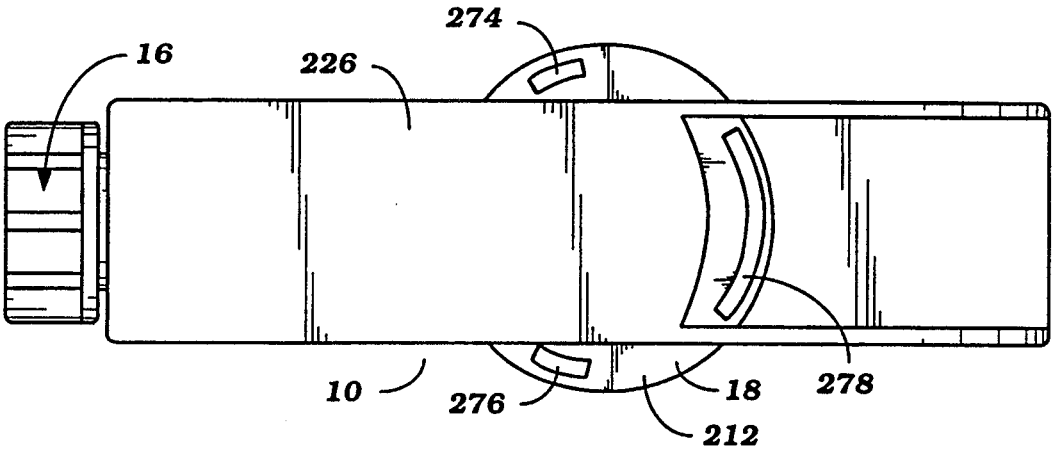
FIG. 3 is a top plan view of the trigger sprayer shown in FIGS. 1 and 2.
Figure 4:
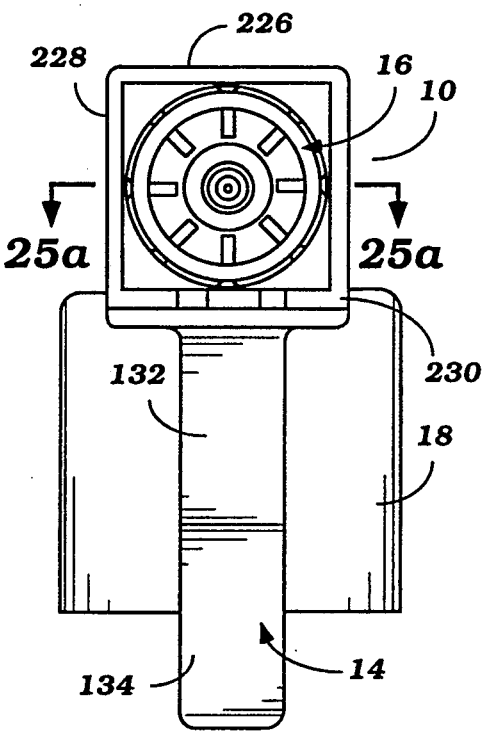
FIG. 4 is a front end elevational view of the trigger sprayer shown in FIGS. 1–3.
Figure 5:
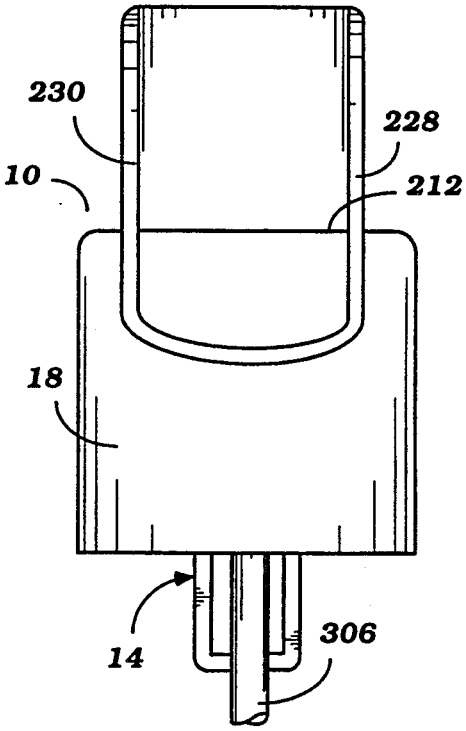
FIG. 5 is a rear end elevational view of the trigger sprayer shown in FIGS. 1–4.
Figure 6:
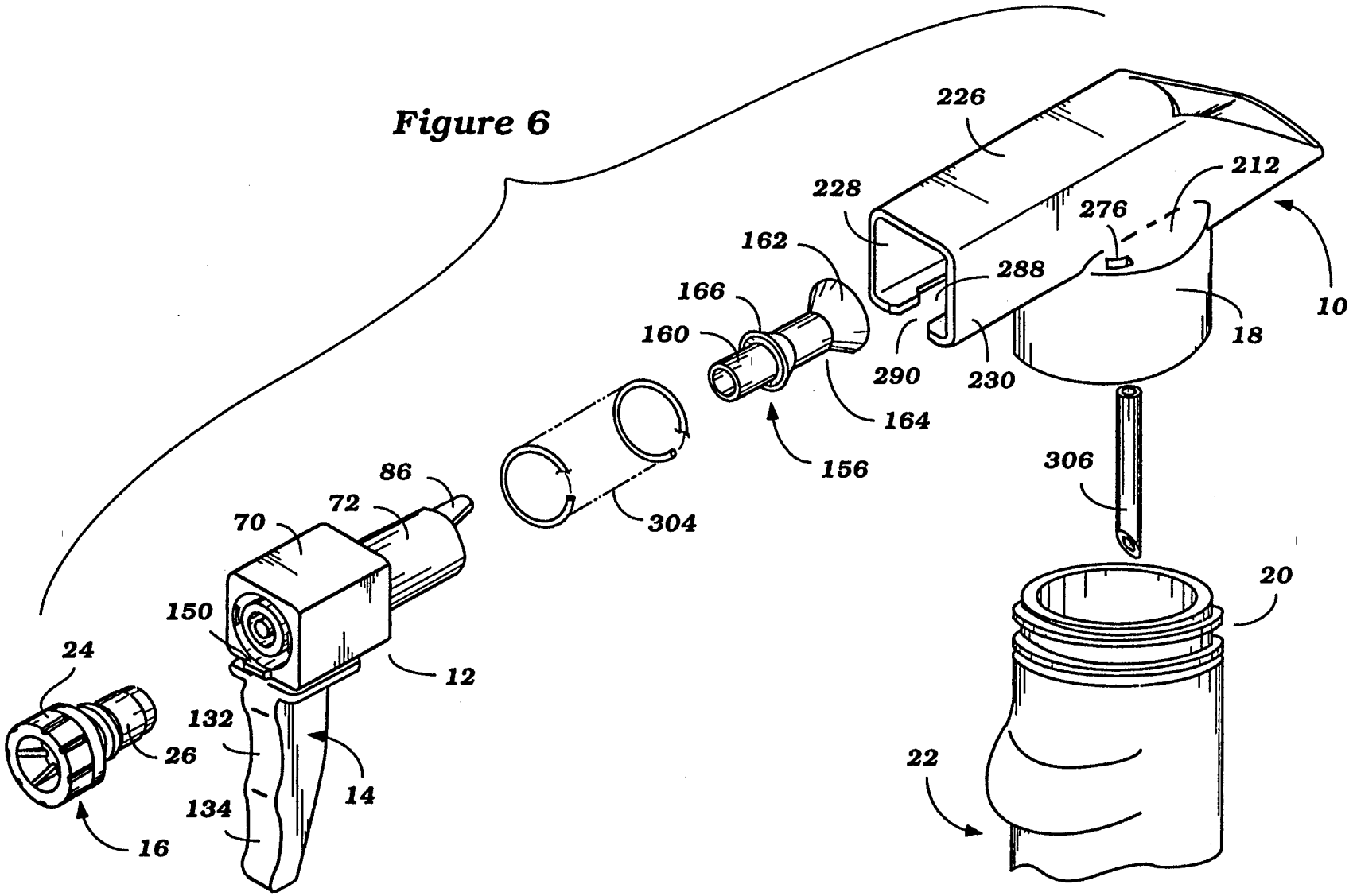
FIG. 6 is an exploded pictorial view of the trigger sprayer shown in FIGS. 1–5, such view showing the upper portion of a bottle to which the trigger sprayer is connected.
Figure 25:
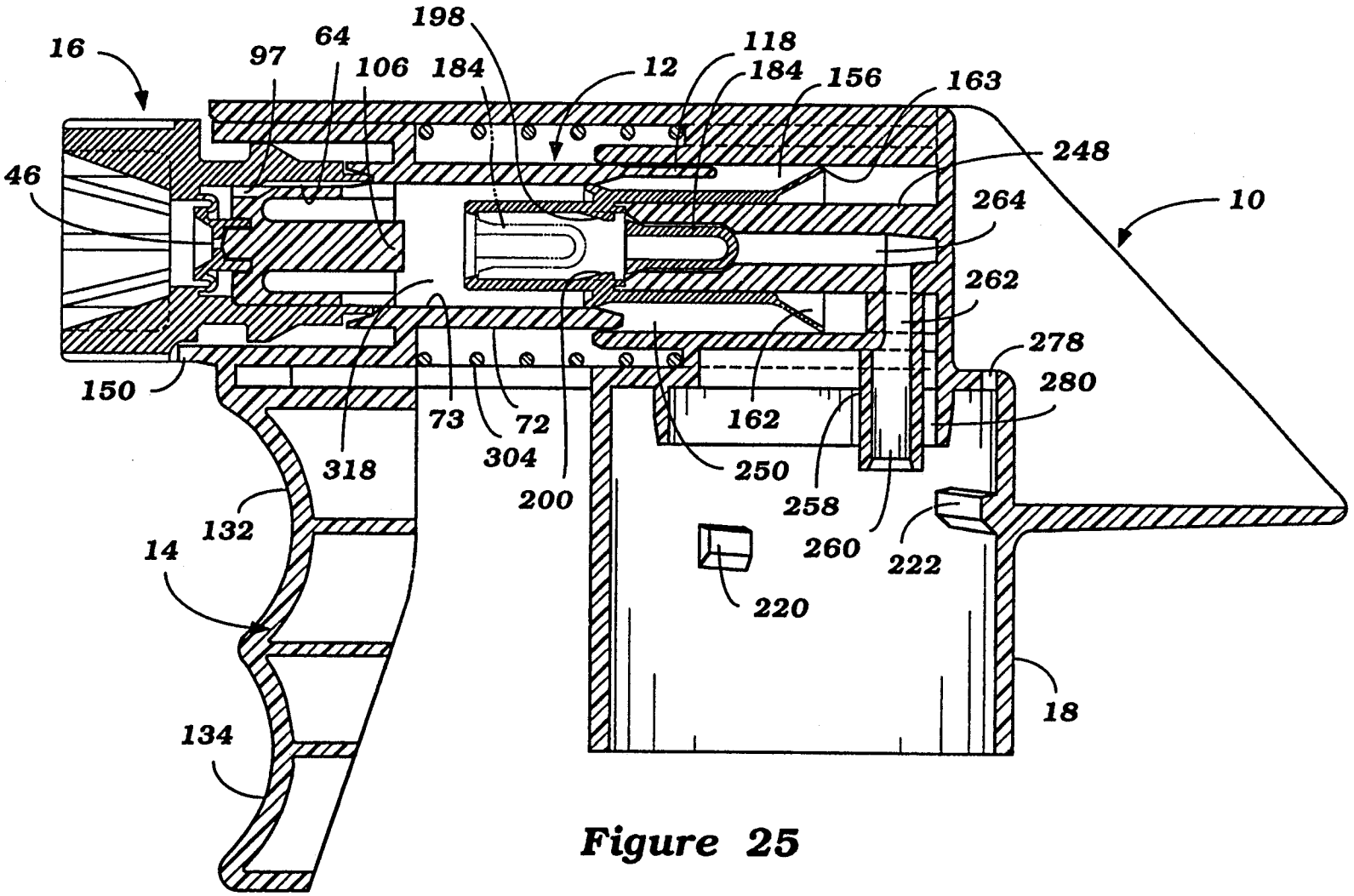
FIG. 25 is a longitudinal sectional view of the various parts of the trigger sprayer assembled together, such view showing the trigger sprayer in a static condition, and including a phantom line showing of the original position of the valve plug.
Figures 25A, 26, 27, 28:
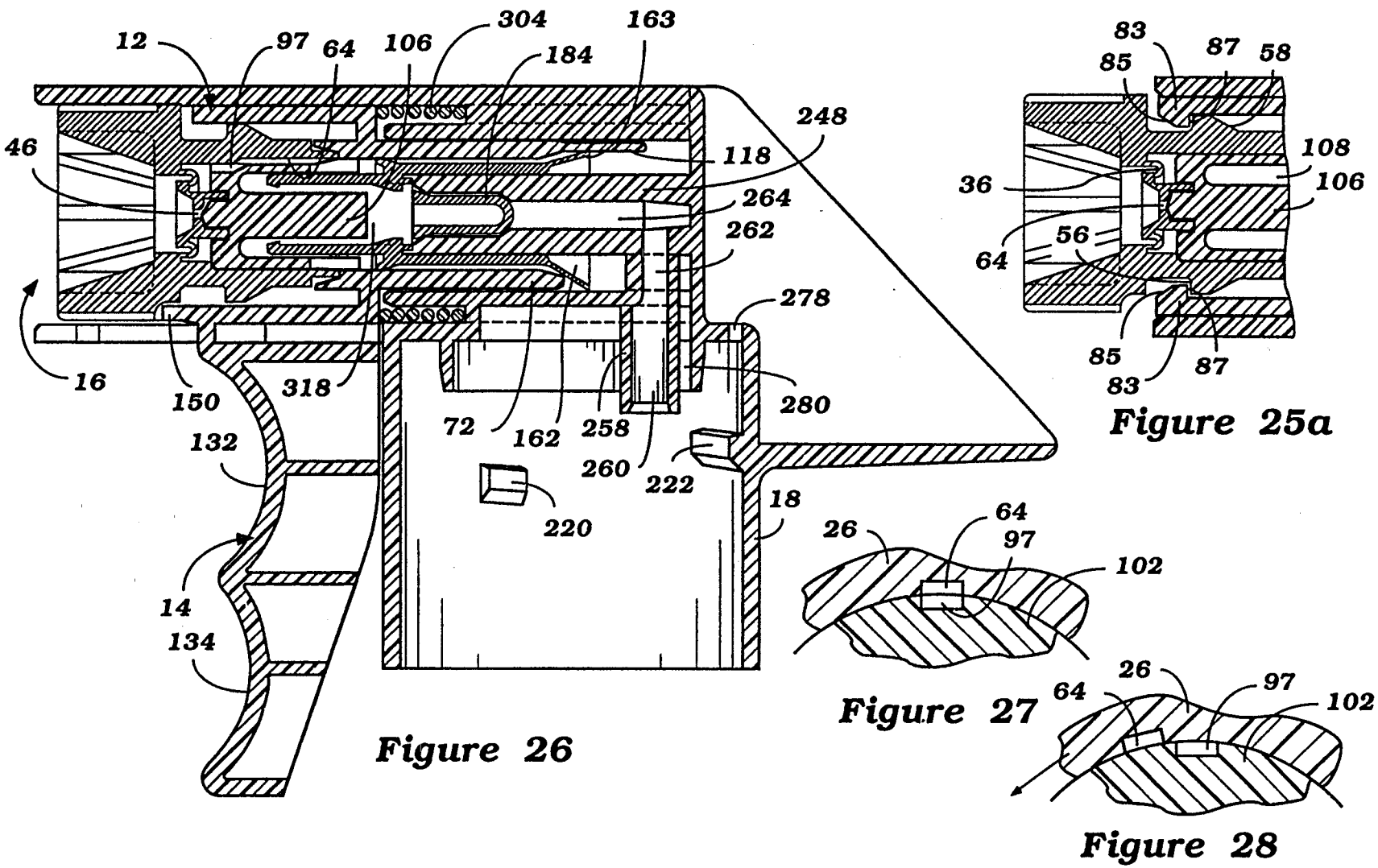
Figure 29:
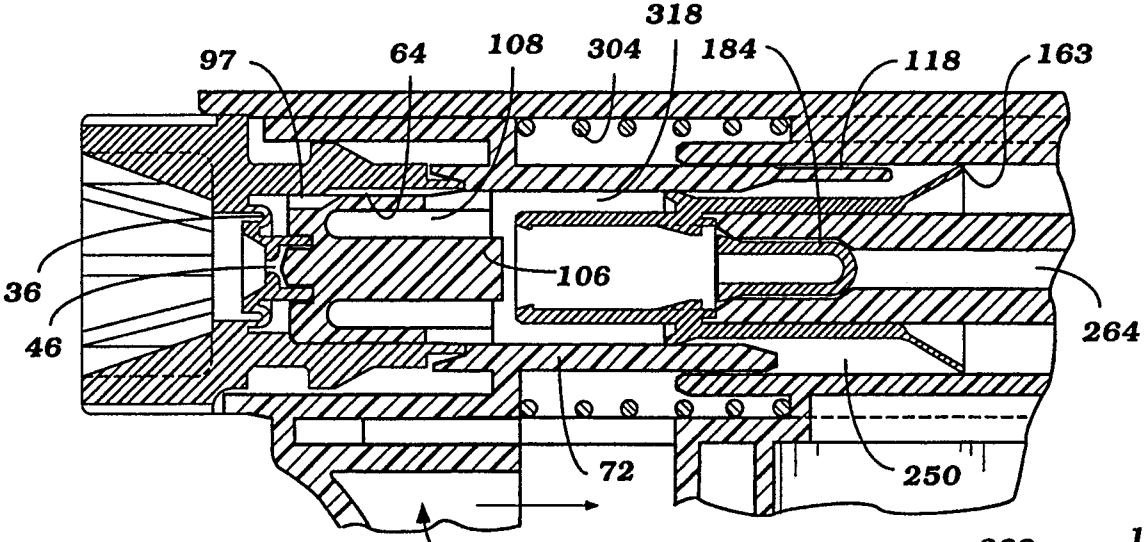
Figure 31:
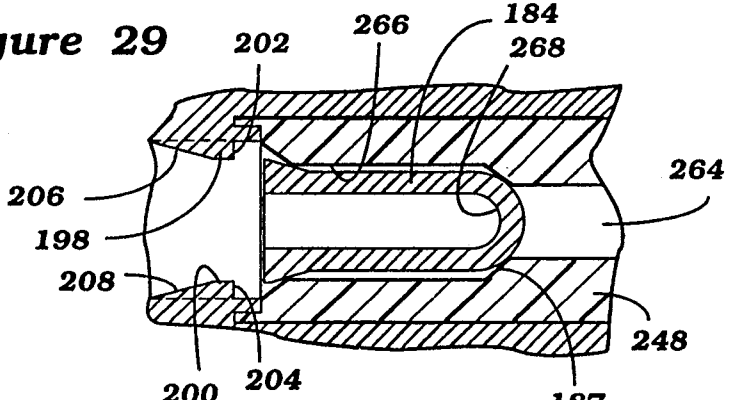
Figure 30:
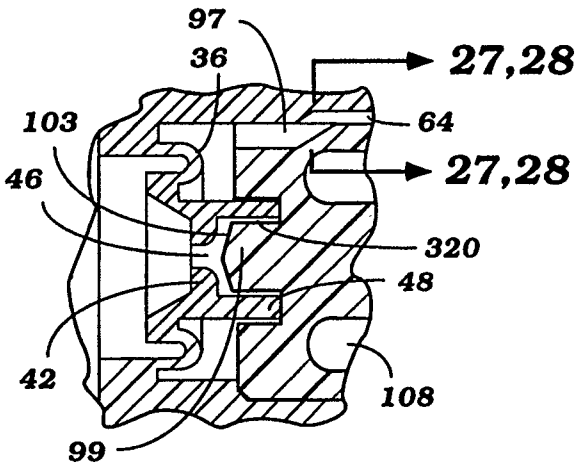
Figure 32:
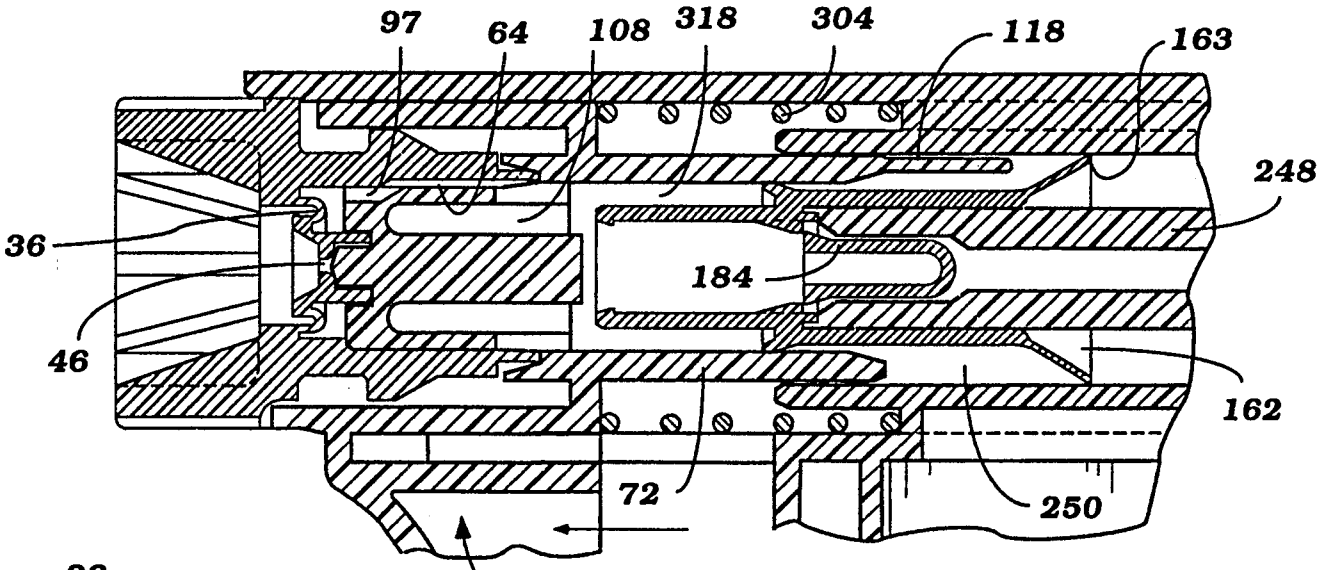
Figure 34:
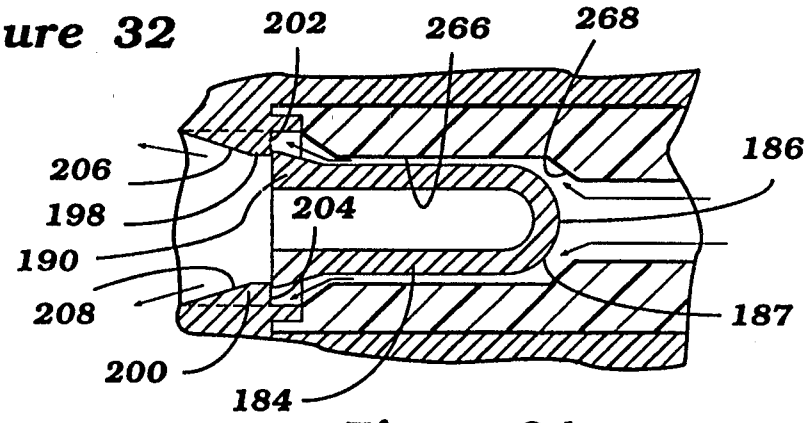
Figure 33:
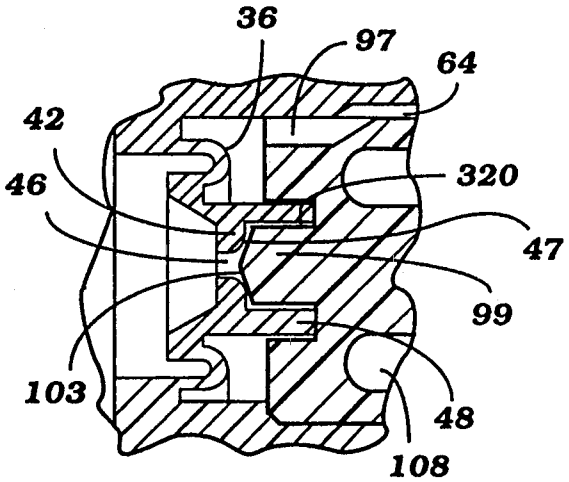
Figure 38:
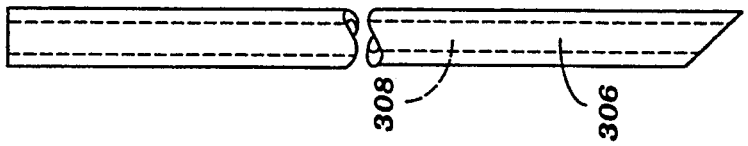
Figure 36:
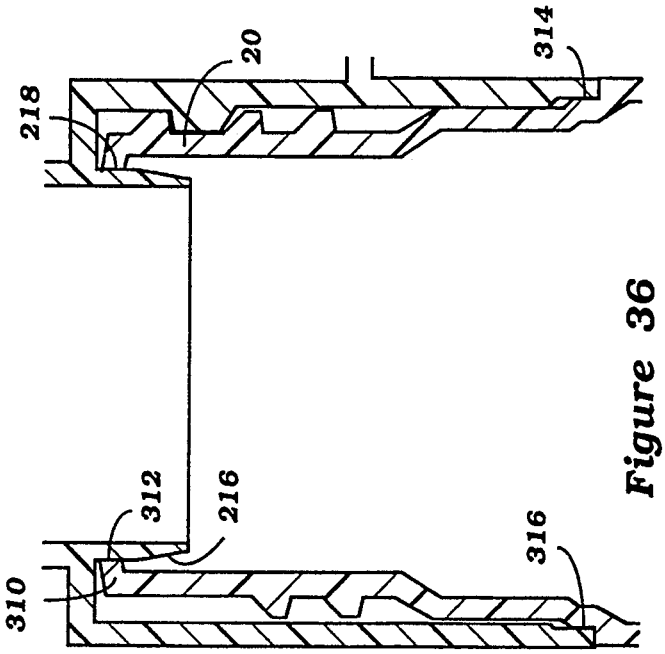
Figure 35:
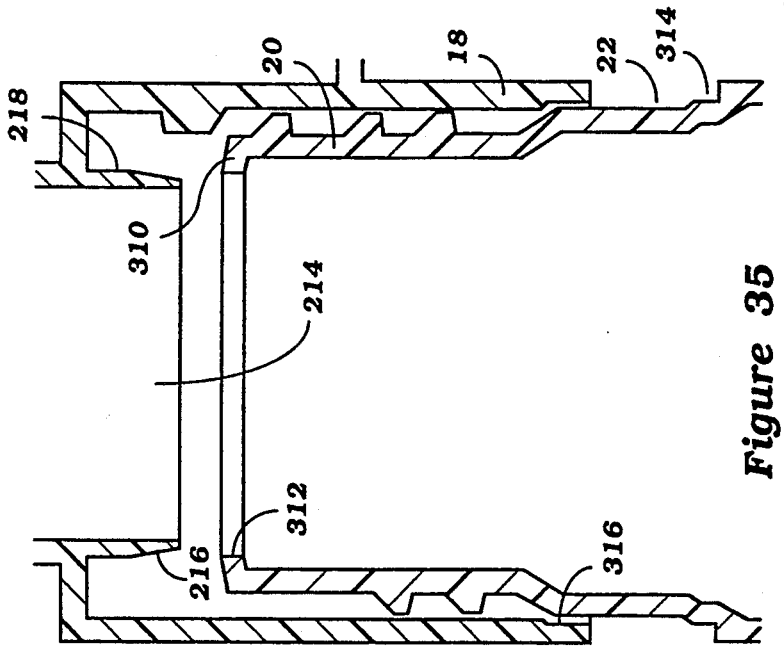
Figure 37:
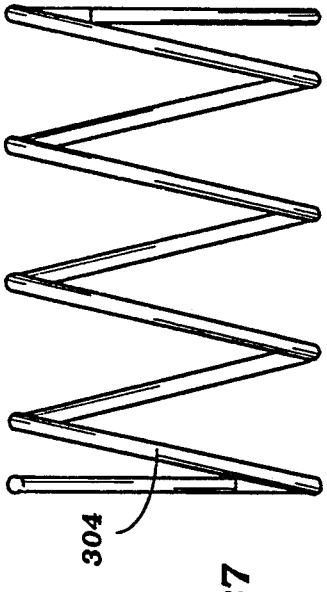
Figure 39:
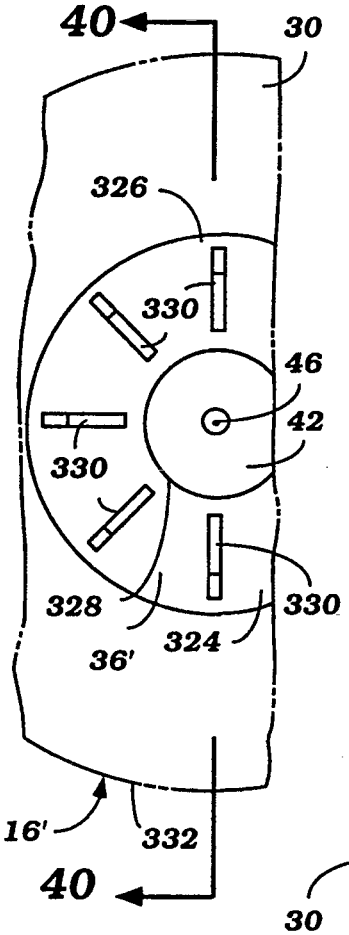
Figure 40:
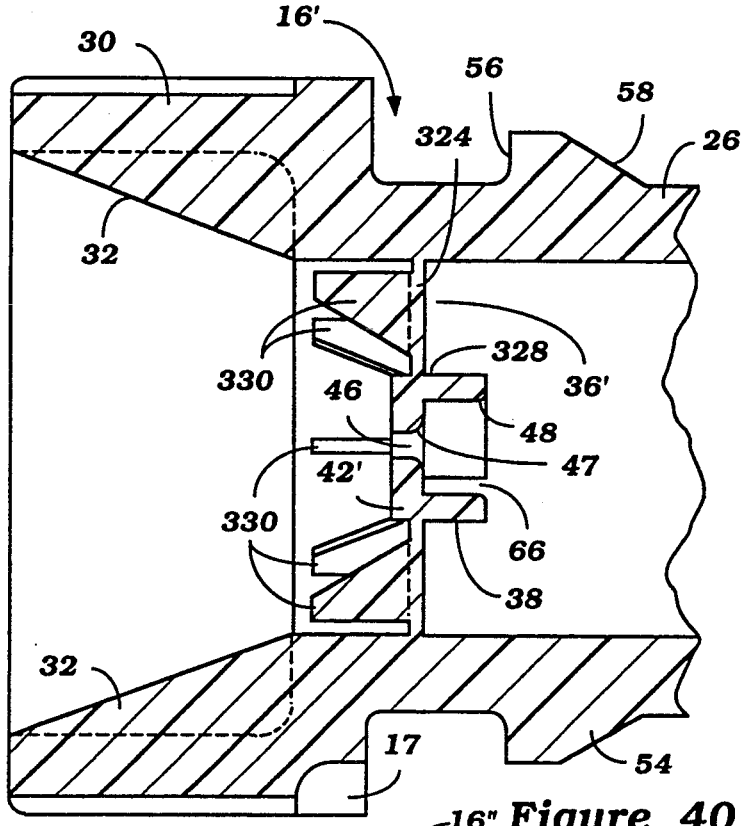
Figure 41:
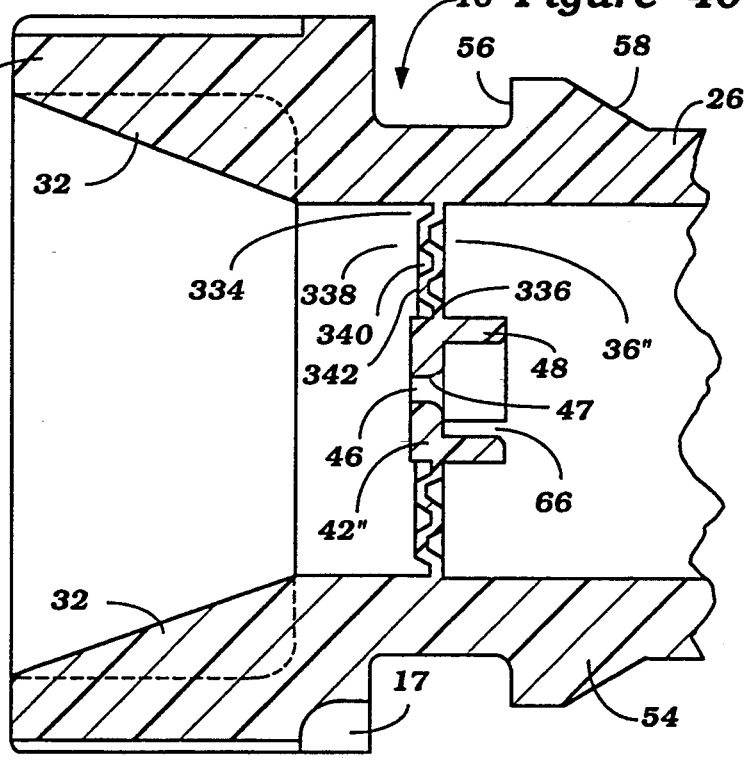
Figure 43:
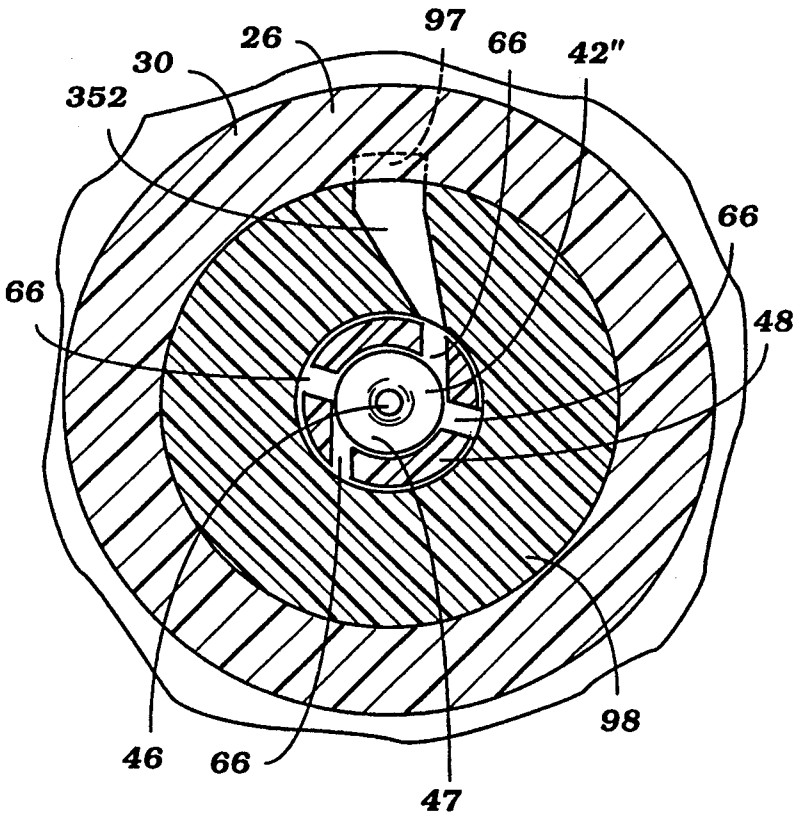
Figure 42:
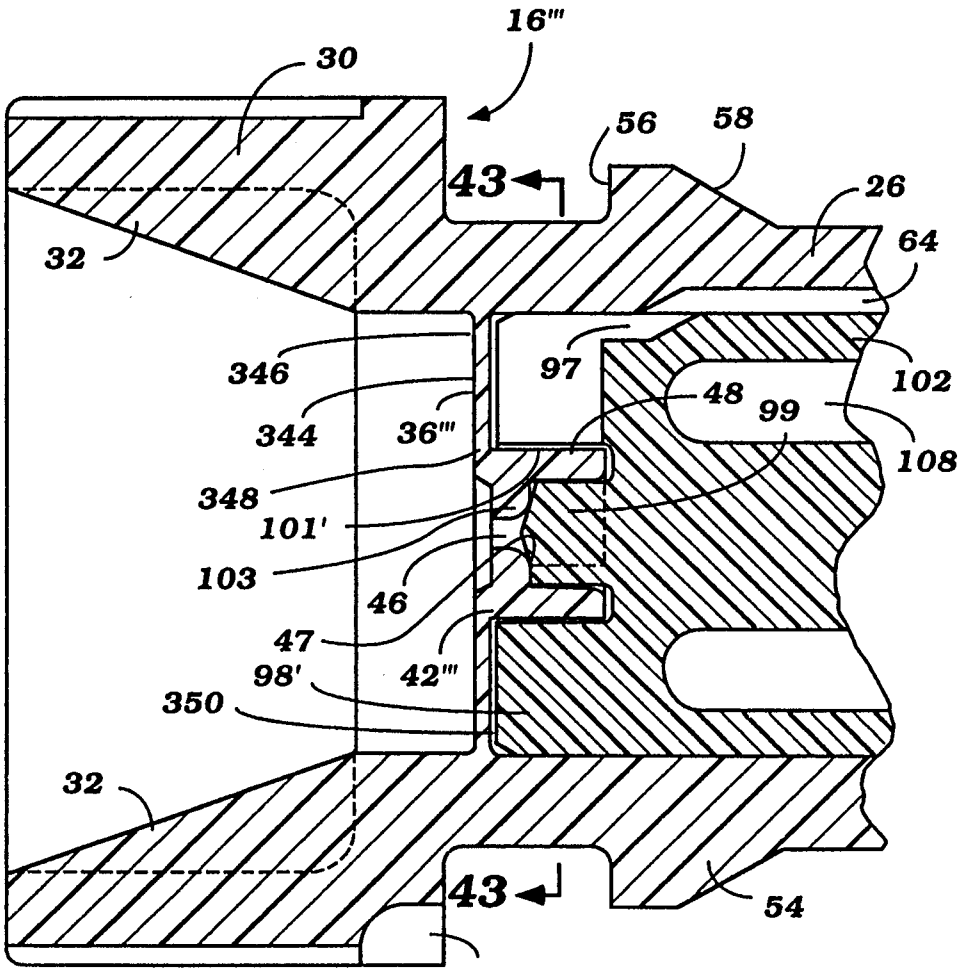
Figure 45:
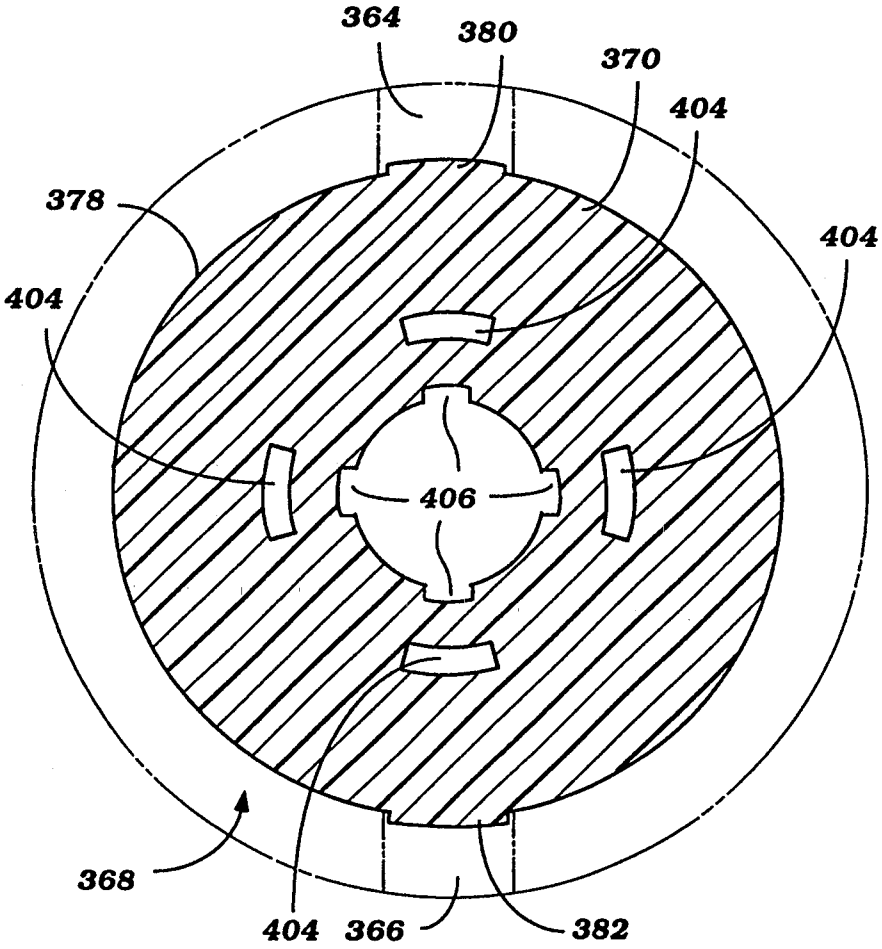
Figure 44:
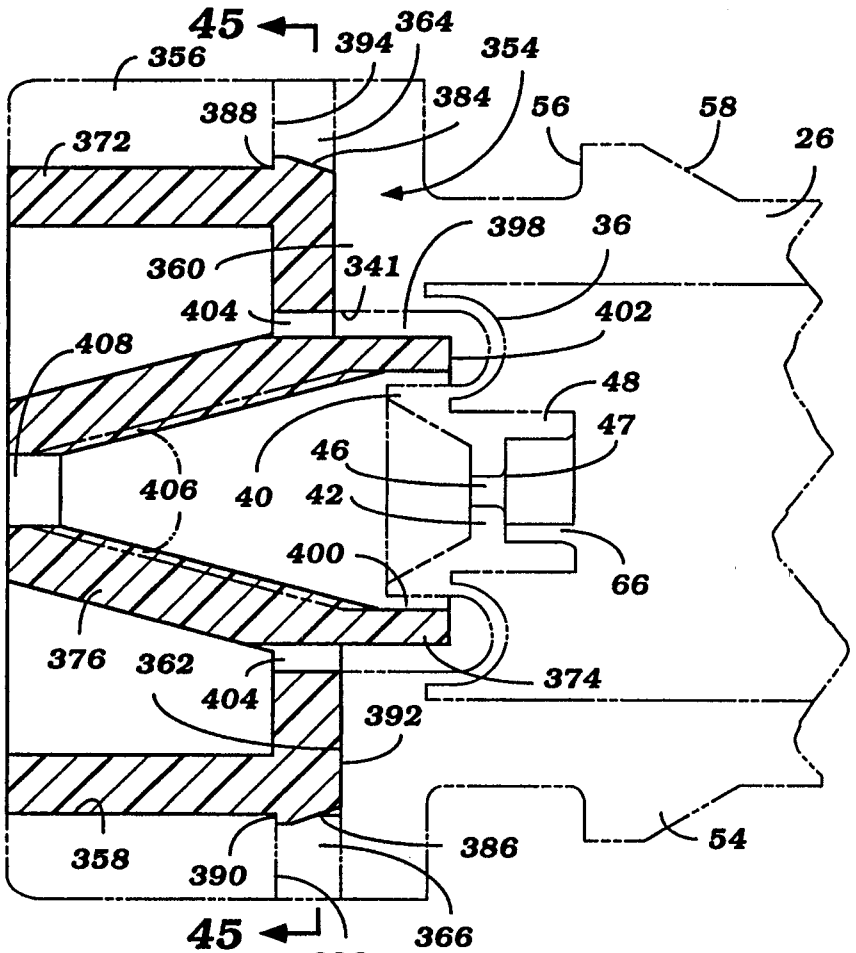
Figures 46, 47:
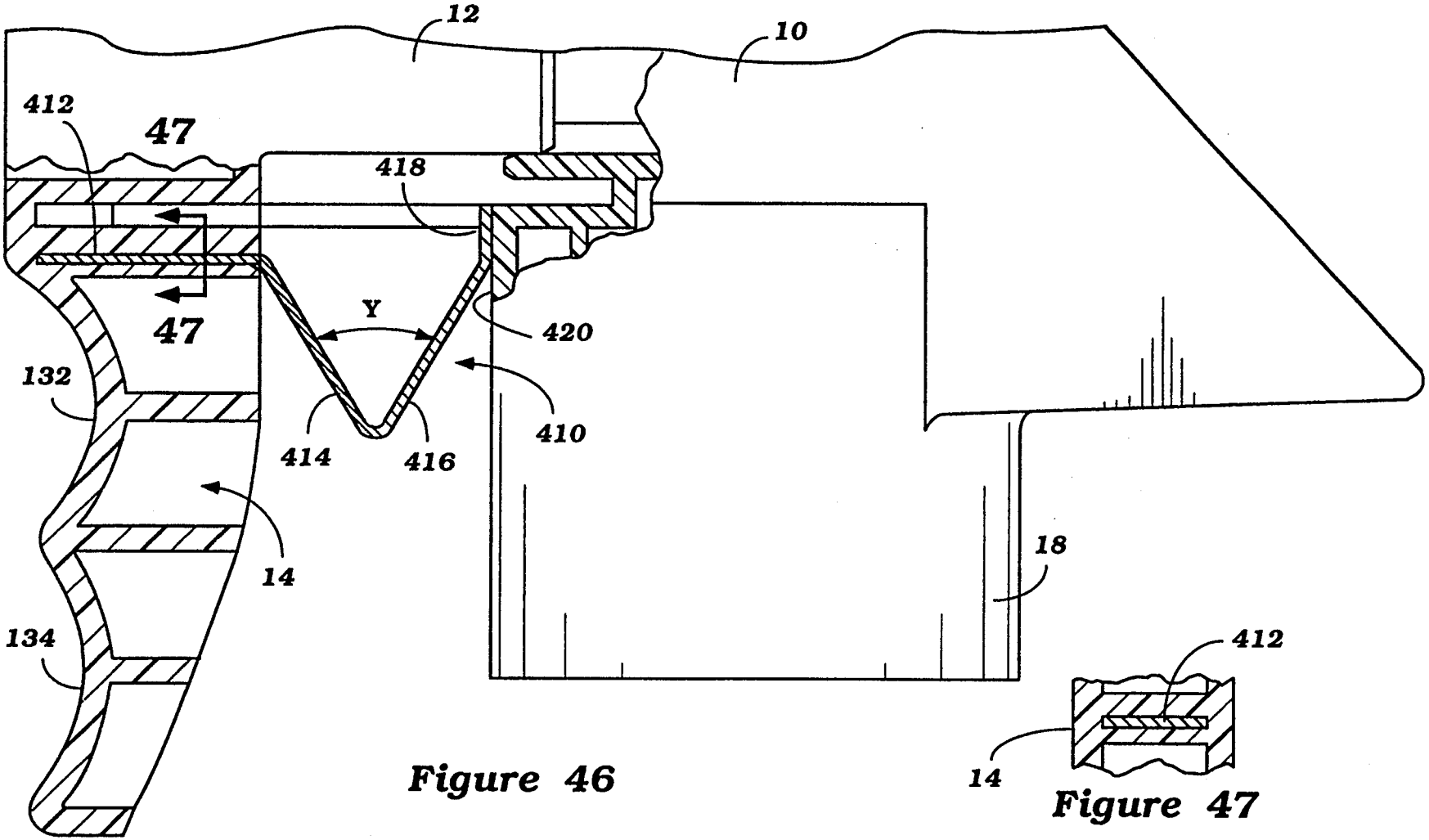
Figure 48:
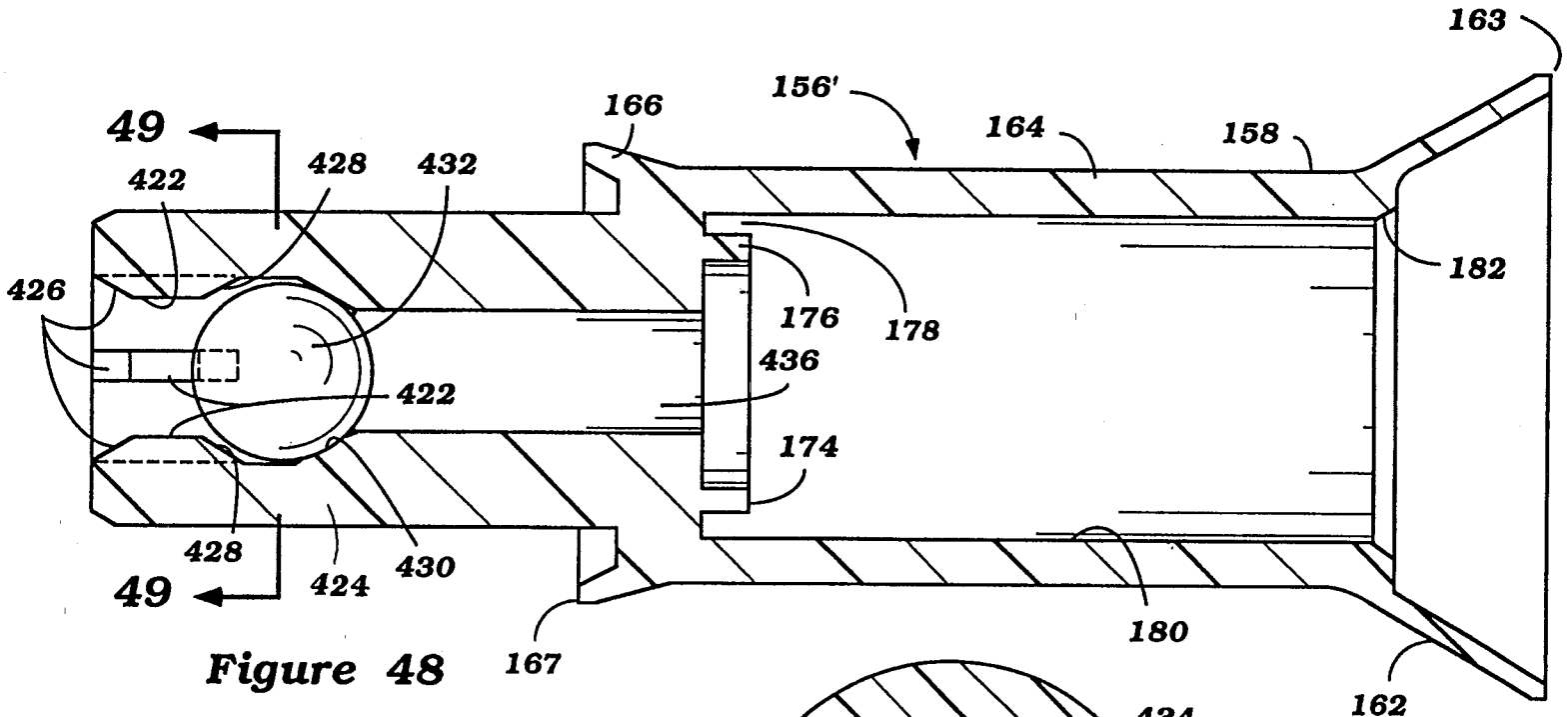
Figure 49:
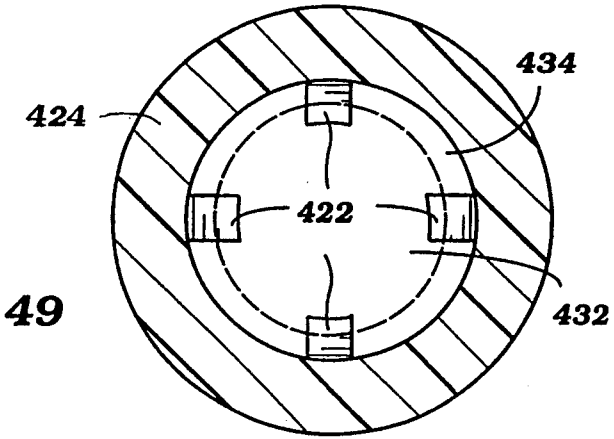

FIG. **25*a* is an enlarged scale fragmentary axial section view taken substantially along line 25*a*—25*a* of FIG. 4**;

FIG. 26 is a view like FIG. 25, but showing the movable housing part, including the trigger, moved towards the fixed housing part;

FIG. 27 is a large scale fragmentary view taken substantially along line 27, 28–27, 28 in FIG. 30, such view showing two sections of a liquid passageway in alignment;

FIG. 28 is a view like FIG. 27, but showing the nozzle in the process of being rotated to move its section of the liquid passageway away from the liquid passageway section that is a part of a movable housing part;

FIG. 29 is a view like FIGS. 25 and 26, but showing the movable housing part being moved towards the fixed housing part, and showing the inlet valve closed and the outlet valve open;

FIG. 30 is an enlarged scale fragmentary sectional view taken in the region of the outlet valve, showing the outlet valve in an open position;

FIG. 31 is an enlarged scale fragmentary sectional view in the vicinity of the inlet valve, showing the inlet valve in a closed position;

FIG. 32 is a view like FIGS. 25, 26 and 29, but showing the movable housing part moving away from the fixed housing part, and showing the inlet valve opened and the outlet valve closed;

FIG. 33 is a view like FIG. 30, but showing the outlet valve closed;

FIG. 34 is a view like FIG. 31, but showing the inlet valve open;

FIG. 35 is a fragmentary vertical sectional view taken through the base portion of the trigger sprayer and the neck portion of a container to which the trigger sprayer is secured, such view showing the trigger sprayer base spaced from the bottle neck;

FIG. 36 is a view like FIG. 35, but showing the trigger sprayer base secured to the bottle neck;

FIG. 37 is a side elevational view of a spring which normally biases the movable housing part away from the fixed housing part;

FIG. 38 is an elevational view of a draw tube that extends downwardly from the trigger sprayer base into liquid within the bottle, such view showing the draw tube broken away at its center so as to shorten the view;

FIG. 39 is a fragmentary front end view of a modified construction of the outlet member;

FIG. 40 is a longitudinal sectional view taken substantially along line 40—40 of FIG. 39;

FIG. 41 is a view like FIG. 40, but showing another modified construction of the outlet member;

FIG. 42 is a view like FIGS. 40 and 41, showing yet another embodiment of the outlet member;

FIG. 43 is a cross sectional view taken substantially along line 43—43 of FIG. 42;

FIG. 44 is a fragmentary longitudinal sectional view taken through the outlet portion of a trigger sprayer, including a solid line showing of a foam forming nozzle, and a phantom line showing of the preferred embodiment of the movable housing part;

FIG. 45 is a sectional view taken substantially along line 45—45 of FIG. 44;

FIG. 46 is a fragmentary view that is partially in elevation and partially in section, showing a modified form of spring provided for biasing the movable housing part away from the fixed housing part;

FIG. 47 is a fragmentary sectional view taken substantially along line 47—47 of FIG. 46;

FIG. 48 is a longitudinal sectional view of a modified form of internal housing, showing the use of a ball shaped valve plug in place of the valve plug shown in the preferred embodiment; and FIG. 49 is a cross sectional view taken substantially along line 49—49 of FIG. 48, such view including a broken line showing of the closure ball.

BEST MODE FOR CARRYING OUT THE INVENTION

Referring first to FIGS. 1-6, the preferred embodiment of the invention is a trigger sprayer comprising a main housing 10, and a forward housing 12. Forward housing 12 includes a trigger part 14 and a nozzle part 16. Housing 10 includes a tubular neck 18 by which it is connected to the upper portion 20 of a bottle 22 which contains a liquid to be sprayed.

Figure 7:
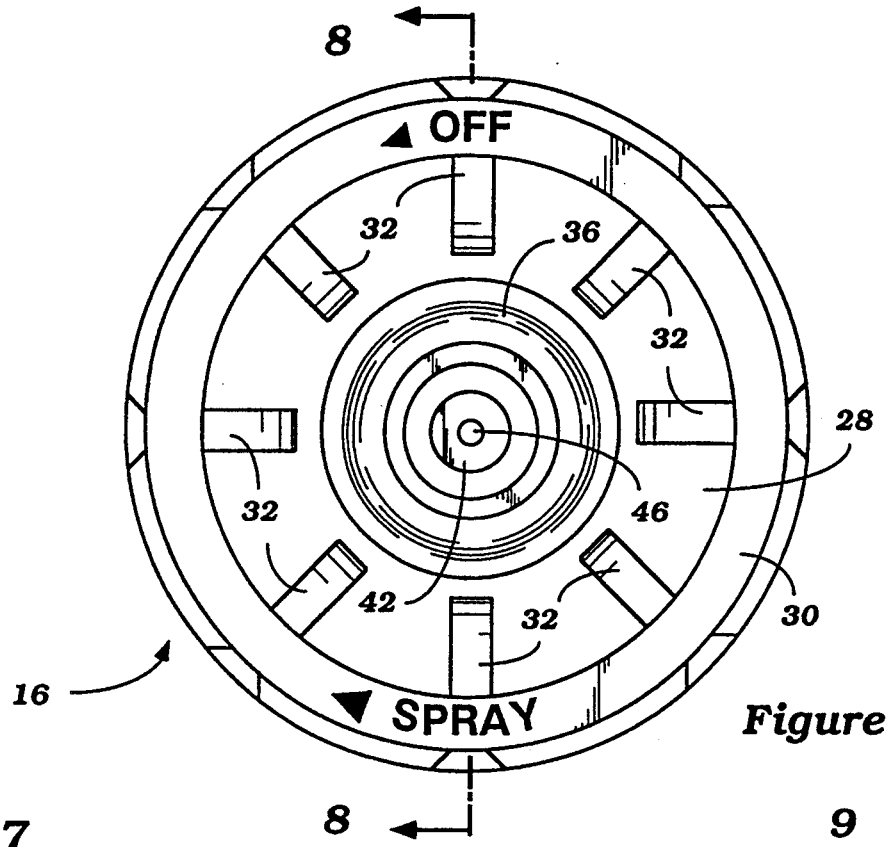
FIG. 7 is an end view taken from the position of line 7—7 in FIG. 8.
Figure 8:
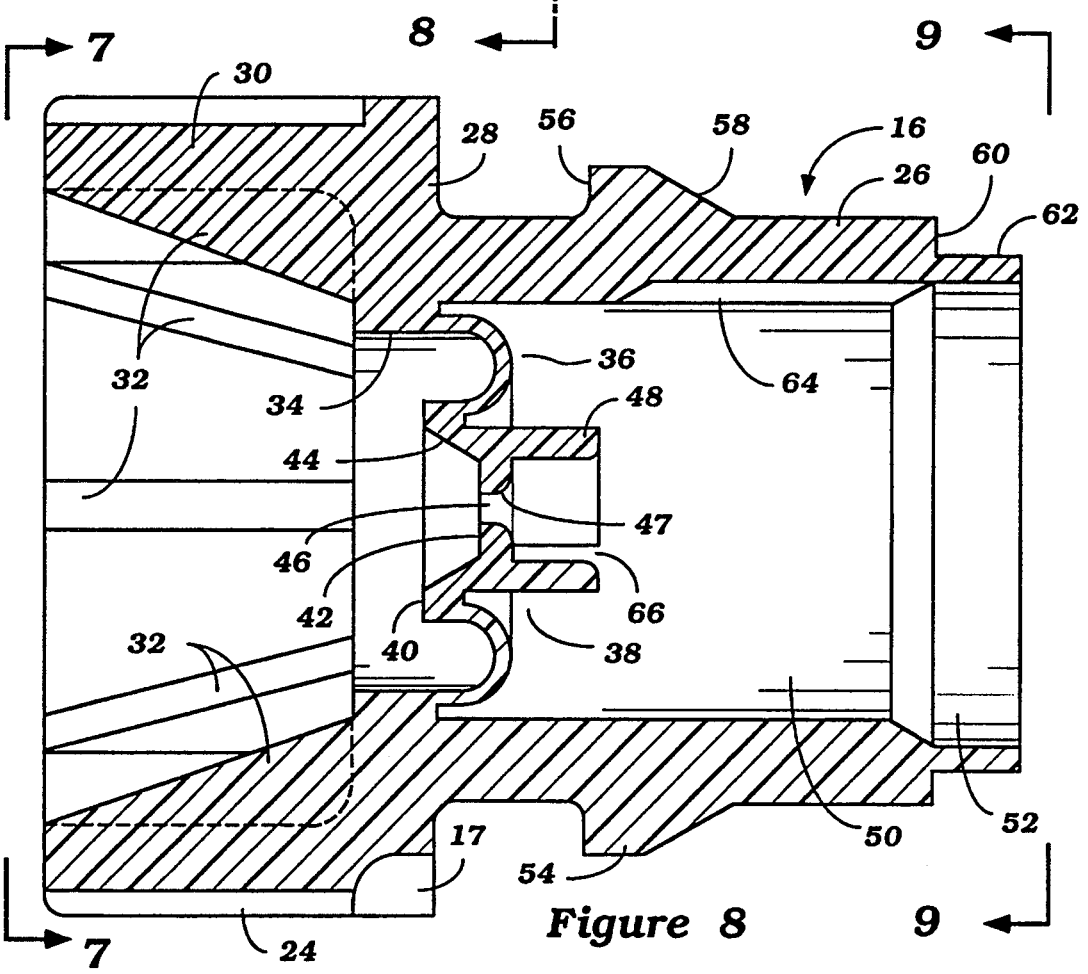
FIG. 8 is a longitudinal sectional view taken substantially along line 8—8 of FIG. 7.
Figure 9:
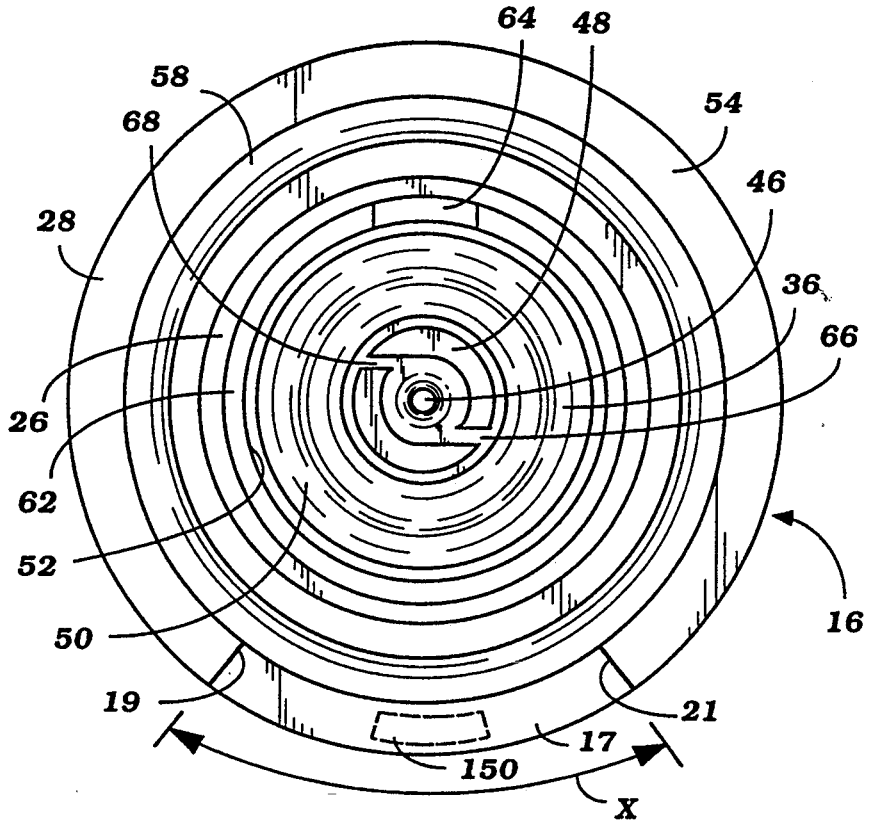
FIG. 9 is an end elevational view taken substantially from the position of line 9—9 in FIG. 8.

Referring to FIGS. 7-9, the nozzle 16 may include a tubular body including a front section 24 and a smaller diameter rear section 26. The front and rear sections 24, 26 meet at a radial wall 28. Front section 24 includes an annular wall 30 which extends axially forwardly from radial wall 28. As best shown by FIGS. 7 and 8, a plurality of triangular gussets 32 extend between annular wall 30 and radial wall 28. Radial wall 28 includes a central circular recess 314 that is substantially closed at its rear by an annular flex wall section 36 and a central outlet structure 38. Flex wall 36 extends rearwardly, then inwardly, and then forwardly, along a curved path, from a connection to radial wall 28, immediately around recess 34, to a connection with a forward cup portion 40 of outlet structure 38. Flex wall 36 includes an annular concave surface, directed forwardly, and an annular convex surface, directed rearwardly. Flex wall 36 permits a limited forward axial movement of outlet structure 38, relative to a static position of such structure 38. Cup portion 40 includes a radial base wall 42 and a forwardly extending, frusto-conical sidewall 44. An outlet opening or orifice 46 is formed in wall 42. An outlet valve seat 47 borders opening 46 on the rear side of wall 42 (FIG. 8). Outlet structure 38 also includes an annular wall 48 which extends axially rearwardly from radial wall 42. As will hereinafter be described, walls 46, 48 are parts of both a spray forming outlet and an outlet valve.

Rear section 26 of nozzle 16 is axially elongated and forms a rearwardly opening socket 50 which includes an enlarged diameter rear portion 52. Rear section 26 includes an annular flange 54 having a substantially radial forward surface 56 and a frusto conical rear surface 58. At rear end of rear section 26 the outer diameter of the section is reduced to form a generally radial shoulder 60 and an axially rearwardly projecting lip 62. As will hereinafter be described, flange 54 and lip 62 are parts of a snap together connection between the nozzle 16 and the forward housing 12. Rear section 26 includes an axial channel or groove 64 that is open at its rear end and closed at its forward end. As will hereinafter be described in some detail, channel 64 is one section of a two section liquid passageway. As shown by FIG. 9, sidewall 48 includes a pair of inlet passageways 66, 68 which extend at a tangent to an inner chamber space that is in part formed by the wall 48.

Figure 10:
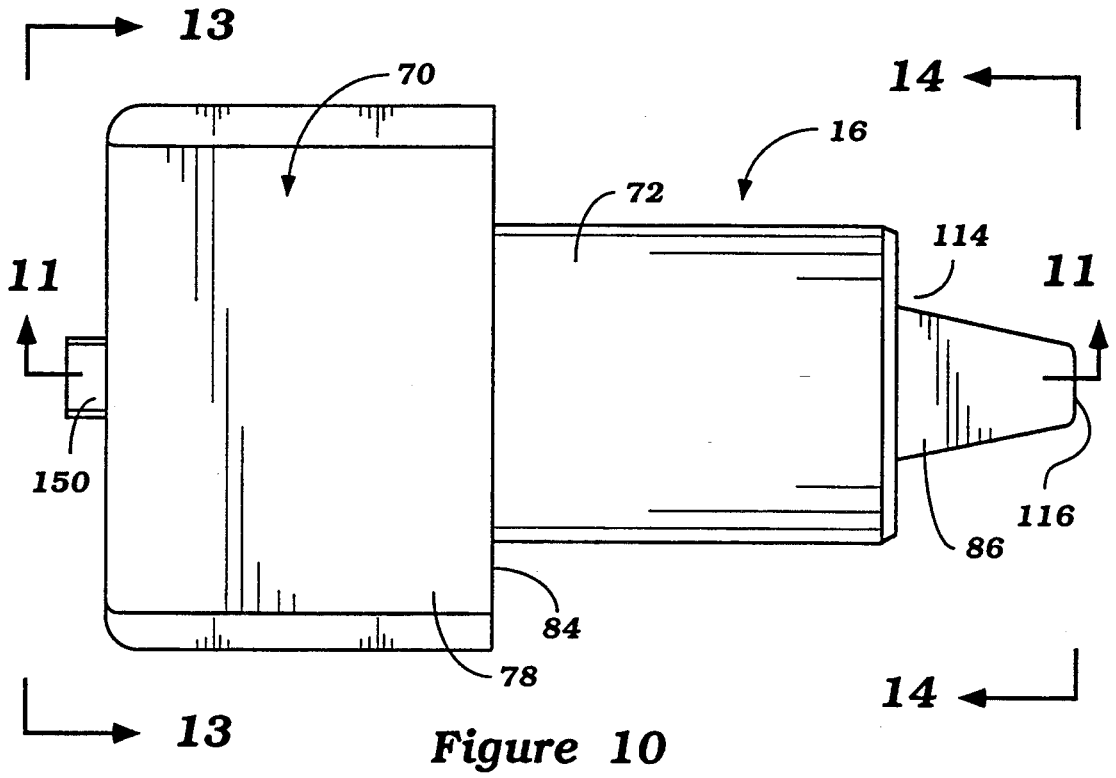
FIG. 10 is a top plan view of the trigger part taken substantially from the position of line 10—10 in FIG. 11.
Figures 11, 12:
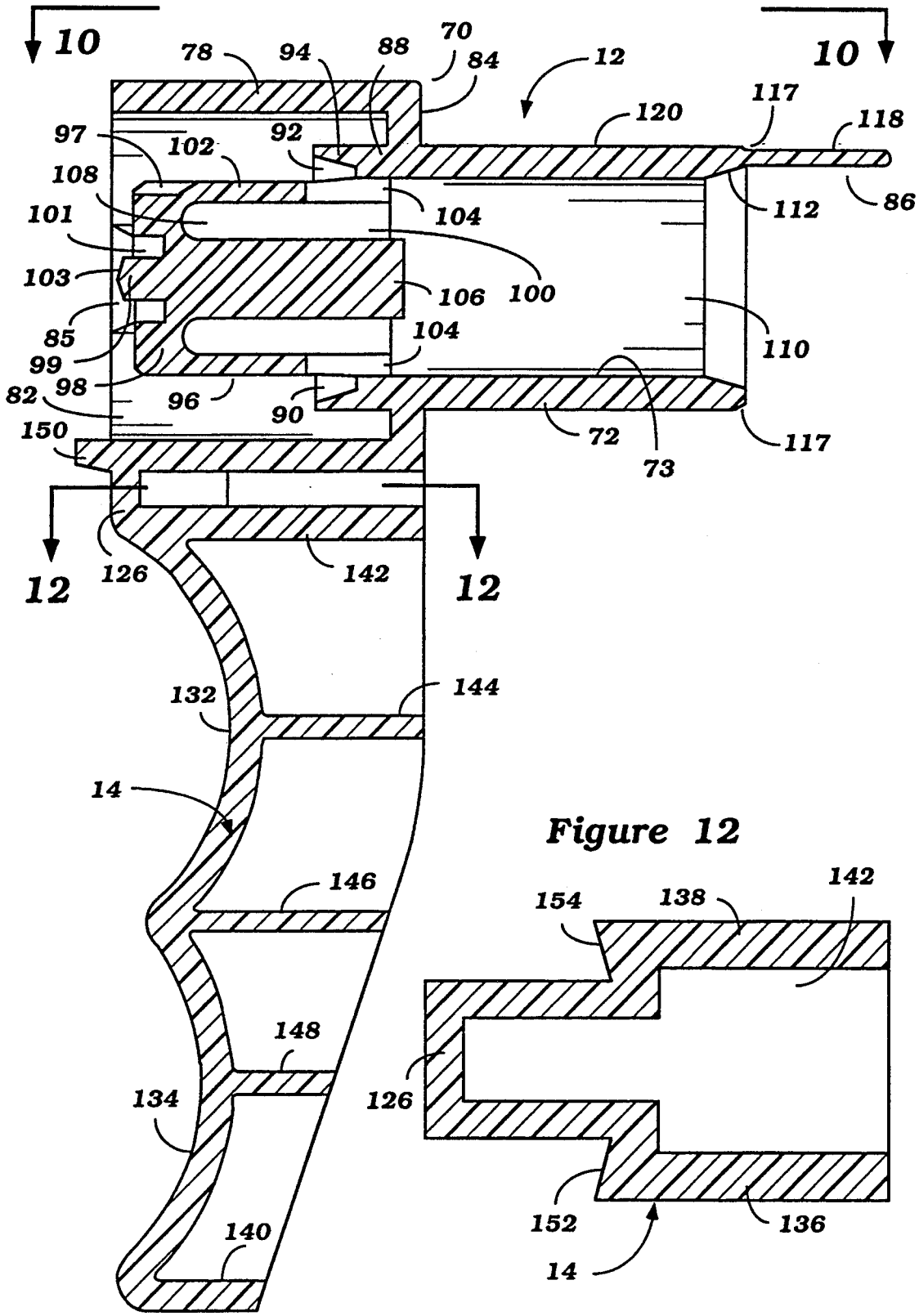
FIG. 11 is a longitudinal sectional view taken substantially along line 11—11 in FIG. 10.
FIG. 12 is a cross sectional view taken substantially along line 12—12 in FIG. 11.

Referring now to FIGS. 10-14, the forward housing 12 includes, in addition to trigger handle 14, a forward tubular section 70 and a rearward tubular section 72. Forward section 70 may have a substantially square, outside cross sectional shape, formed by opposite sidewalls 74, 76, a top wall 78 and a bottom wall 80. A front end of box section 70 is open at 82. The rear end of walls 74, 76, 78, 80 meet and are joined to an end wall 84. Space 82 is annular but includes lugs 83 at its sides, each having a lead in cam surface 85 and a radial rear surface 87. Tubular section 72 is also connected to end wall 84. A main portion of tubular section 72 extends axially rearwardly from end wall 84 and has a substantially constant outside diameter for essentially all of its length. It includes an inner surface 73 and an axially rearwardly projecting finger 86. It also includes a substantially constant inside diameter for most of its length. As shown in FIG. 11, tubular section 72 includes a forward portion 88 that extends axially forwardly from wall 84 to an end 90. The end 90 includes an end socket 92 which has a forwardly diverging sidewall 94. An end cup 96 extends forwardly from wall portion 88. Cup 96 has a closed front end 98, an open rear end 100 and a sidewall 102, connected at its rear to the forward portion 88 of tubular section 72. Front end 98 includes a pin 99 surrounded by an annular socket 101. Pin 99 includes a forwardly directed closure surface 103. Closure surface 103 may be a conical surface. Radial openings 104 communicate socket 92 with the interiors of tubular section 72 and cup 96. Cup 96 includes a central axial member 106 that is connected at its forward end to wall 98. Axial member 106 extends axially rearwardly from wall 98 substantially to end wall 84. An annular chamber 108 is formed by and radially between sidewall 102 and axial member 106. Open end 100 is the rear end of chamber 108. It communicates with a chamber 110 formed by and within the main portion of tubular section 72. The rear end of chamber 110 includes a frusto-conical surface 112. Surface 112 is a rearwardly divergent surface which forms a flared inlet into chamber 110, for reasons that will hereinafter be explained.

Referring to FIG. 10, finger 86 has a wide forward base 114 and a narrow rear end 116. The side edges of finger 86 converge together as they extend from the base 114 to the end 116. Finger 86 is a section of an annular sidewall, such section having the plan form shown in FIG. 10 and the lateral curvature shown in FIG. 14. As best shown in FIG. 11, the outer surface 118 of finger 86 is offset radially inwardly from the outer surface 120 of tubular section 72. The reason for this feature is hereinafter explained.

Figure 13:
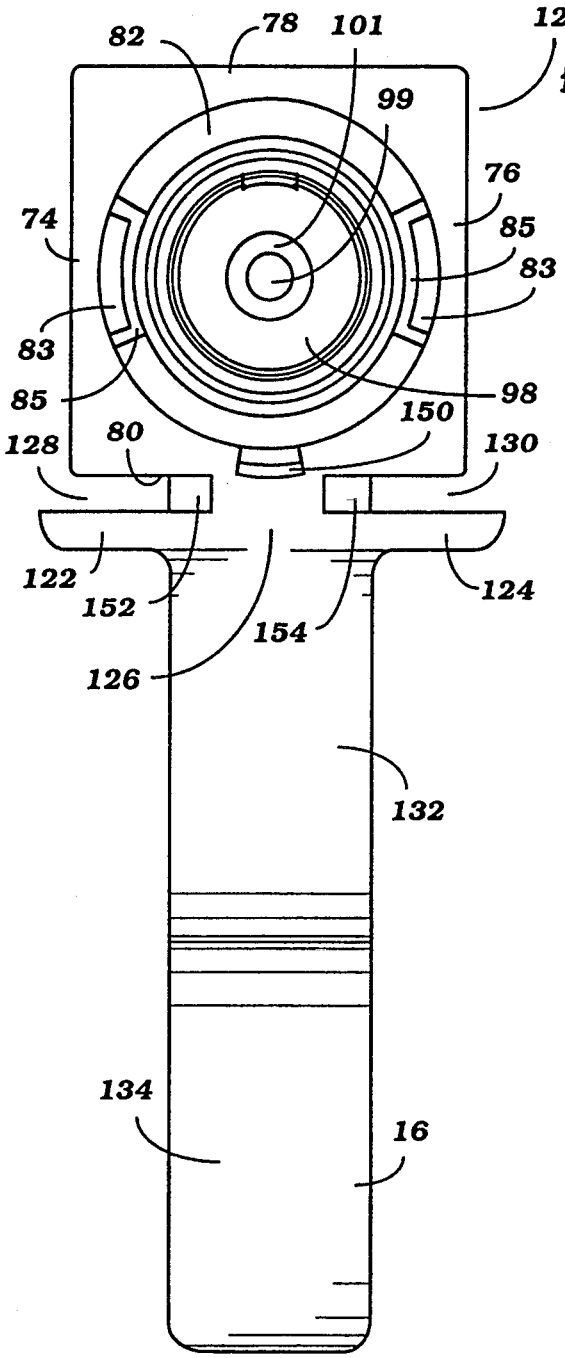
FIG. 13 is an end elevational view taken substantially from the position of line 13—13 in FIG. 10.
Figure 14:
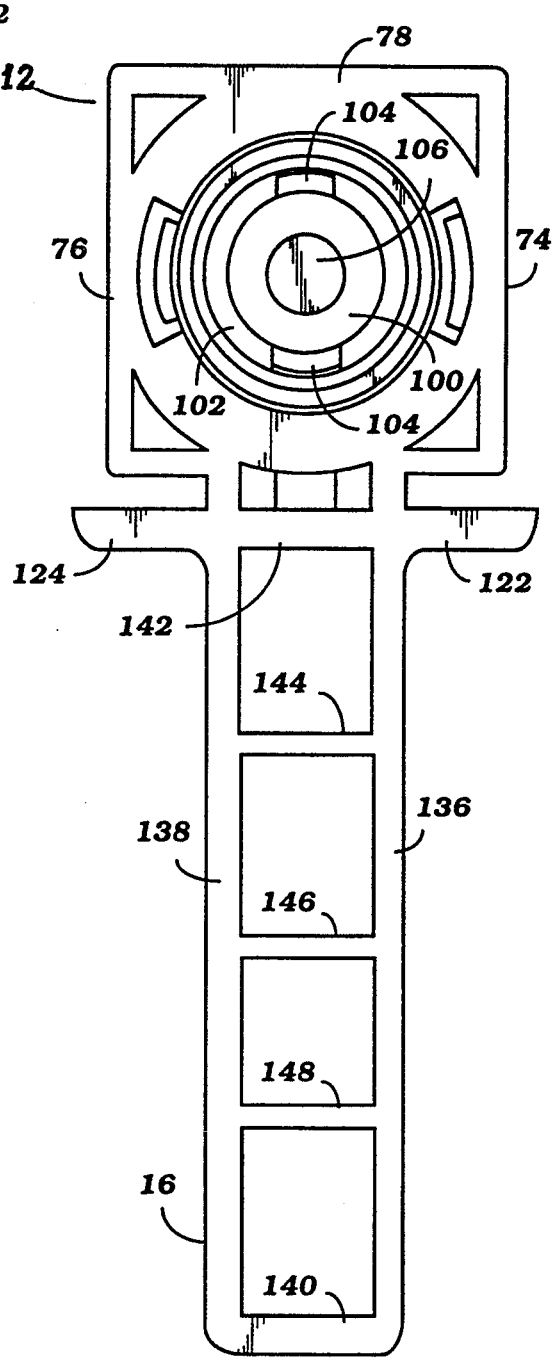
FIG. 14 is an opposite end view taken substantially from the position of line 14—14 in FIG. 10.

As shown by FIGS. 13 and 14, a pair of flanges 122, 124 project laterally outwardly from the upper end of trigger 14. A narrow neck 126 extends between trigger 14 and a central portion of housing wall 80. Flanges 122, 124, neck 126 and wall 80 together form a pair of side passages 128, 130 which receive portions of the main housing 10 when the sprayer is assembled. As illustrated, trigger 14 may have a forward wall configured to include two finger receiving recesses 132, 134. Trigger 14 may have a substantially U-shaped cross sectional configuration (FIG. 12) formed by the forward wall and a pair of sidewalls 136, 138. Sidewalls 136, 138 may be connected by a lower end wall 140 and a plurality of transverse webs 142, 144, 146, 148. Neck 126 may at the rear of trigger 14 be formed by upward continuations of the sidewalls 136, 138. Flanges 122, 124 may be laterally outwardly extensions of web 142. This construction of the trigger 14 provides both a strong trigger and a saving of material.

A short tongue 150 projects forwardly from wall 80, above neck 126. A pair of stop surfaces 152, 154 (FIG. 12) are formed on the sides of neck 126, where neck 126 joins the upper portions of sidewalls 136, 138.

FIGS. 15–18 show an inlet valve housing 156 that is an insert for the main housing 10. Inlet valve housing 156 includes a first end portion 158 and a second end portion 160. First end portion 158 has a seal section 162 at the rear end of the housing 156, and an elongated straight section 164 extending axially forwardly from seal section 162. A second seal section 166 is located at the forward end of straight section 164. Second end portion 160 includes a tubular straight section 168 that is both shorter and smaller in diameter than straight section 164. Sections 164, 168 are connected together by a radial wall 170. Seal section 162 is frusto-conical. It diverges endwise outwardly from the rear end of section 164. Seal section 166 is also frusto-conical. It diverges endwise outwardly from the opposite or forward end of straight section 164, starting from generally where it joins radial wall 170.

The straight section 168 includes a cylindrical inner surface 172 that extends rearwardly to an end surface 174. End surface 174 is at the rear end of an annular tongue 176 that is surrounded by an annular groove 178. The outer radial boundary of groove 178 is formed by the forward end of a cylindrical surface 180 that is the inner surface of tubular section 164. A chamfer 182 is formed at the rear end of the chamber formed by tubular section 164. Chamfer 182 provides a flared entrance into the chamber.

Figures 15, 16, 17, 18:
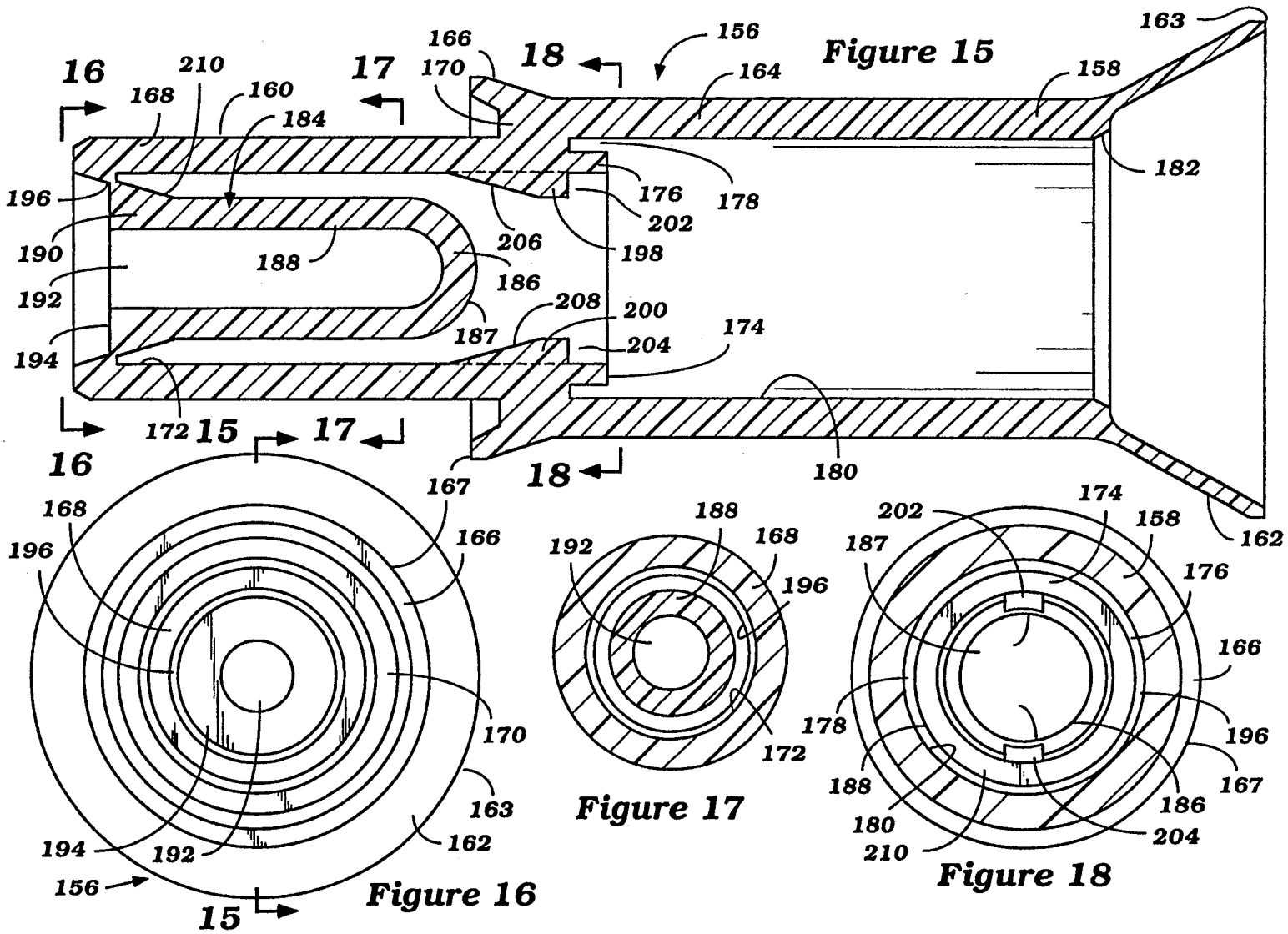
FIG. 15 is a longitudinal sectional view of an internal housing part, taken substantially along line 15—15 of FIG. 16.
FIG. 16 is an end elevational view of the part shown in FIG. 15, taken substantially from the position in line 16—16 of FIG. 15.
FIG. 17 is a cross sectional view taken substantially along line 17—17 in FIG. 15.
FIG. 18 is a cross sectional view taken substantially along line 18—18 in FIG. 15.

Inlet valve housing 156 is formed to include an elongated valve plug 184 that is initially attached to the front end of tubular section 168. In preferred form, valve plug 184 includes a hemispherical shaped rear end portion 186, a tubular sidewall 188, a frusto-conical front end portion 190 and an elongated central opening 192. Rear end portion 186 presents a rearwardly directed convex closure surface. End portion 190 includes a radial end surface 194. Valve plug 184 is initially connected to tubular section 168 by a frangible section 196. The initial disposition of valve plug 184 within inlet valve housing 156 is shown by FIG. 15. Inlet valve housing 156 is also formed to include a pair of diametrically opposed stop lugs 198, 200. The radial distance between the inner radial boundaries of stop lugs 198, 200 is smaller than the outer diameter of front end portion 190 of valve plug 184. Stop lugs 198, 200 include generally radial stop surfaces 202, 204 at their rear ends. They include sloping cam surfaces 206, 208 at their forward ends. A sloping cam surface 210 is formed on the outside of valve plug end portion 190.

Figure 19:
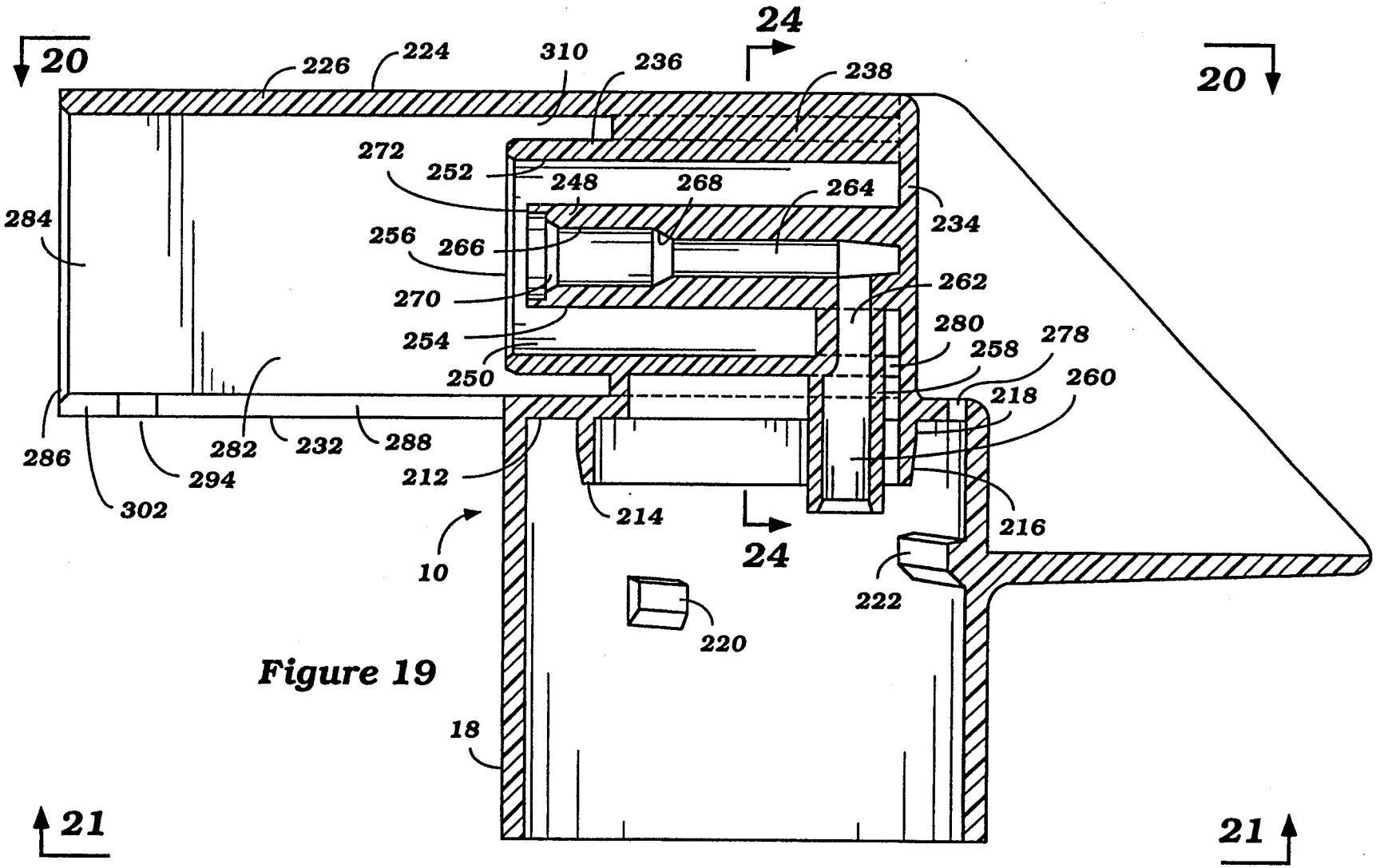
FIG. 19 is a longitudinal sectional view taken substantially along lines 19—19 in FIG. 20 and 22.
Figure 20:
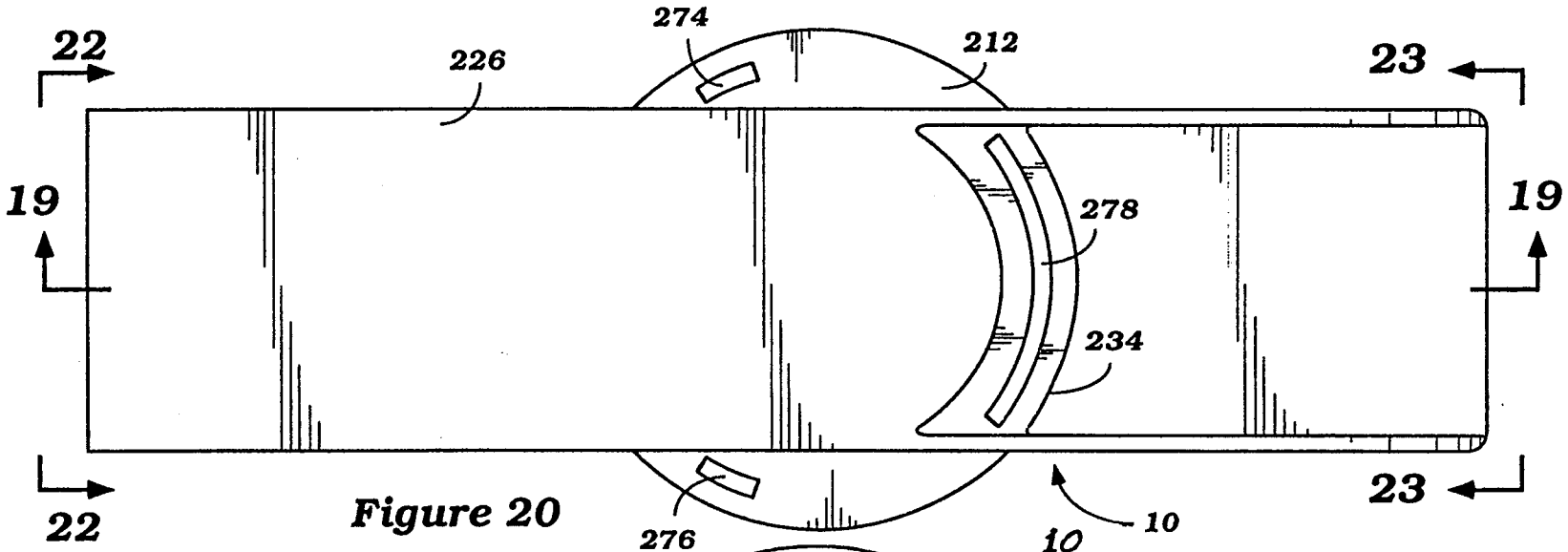
FIG. 20 is a top plan view of the housing part shown by FIG. 19, taken substantially from the position of line 20—20 in FIG. 19.
Figure 24:
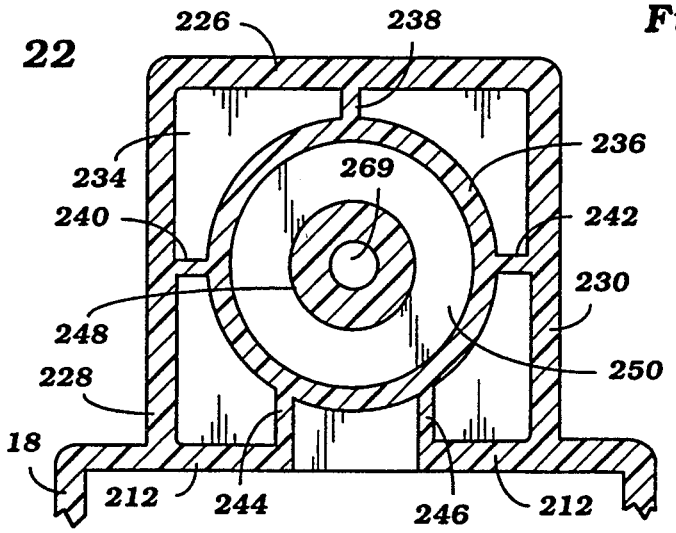
FIG. 24 is a cross sectional view taken substantially along line 24—24 in FIG. 19.

Referring now to FIGS. 19–24, the tubular neck 18 of main housing 10 includes a top wall 212. An annular flange 214 extends downwardly from wall 212. Flange 214 may include a slightly tapered outer surface 216 at its lower end and a generally cylindrical upper surface 218. Internal threads 220, 222 are provided in neck 18, for engaging external threads on the upper end portion 20 of the bottle 22. An elongated upper housing part 224 is secured to the top of neck 18. Housing part 224 includes a substantially planar upper wall 226, substantially planar side walls 228, 230 and a substantially planar lower wall 232. These walls 226, 228, 230, 232 meet and are connected to a rear wall 234. A tubular inner wall 236 is connected to walls 226, 228, 230, 232 by webs 238, 240, 242, 244, 246 (FIG. 24), Tubular wall 236 extends axially of the housing part 224 (FIG. 19) and is substantially centered within the housing part 224 (FIG. 24). An elongated stem part 248 extends axially within tubular wall 236. An annular space 250 is formed by and between tubular wall 236 and stem part 248. The inner surface 252 of tubular wall 236 is cylindrical and the outer surface 254 of stem part 248 is cylindrical. A chamfer 256 may be provided at the inlet to space 250 (FIG. 19). A second stem part 258 is vertically disposed and at its upper end it connects to stem part 248. Stem part 258 includes a cylindrical inlet socket 260 which communicates with a vertical inlet passageway 262. Passageway 262 communicates with a horizontal inlet passageway 264 within stem part 248. The forward end of inlet passageway 264 includes a valve plug receiving socket 266. Socket 266 is larger in diameter than inlet passageway 264. An annular inlet valve seat 268 is formed at the base of socket 266. In preferred form, inlet seat 268 is frusto-conical, as illustrated. A chamfer 270 is formed at the inlet to socket 266. A tubular tongue 272 projects axially forwardly at the forward end of stem part 248. Wall 212 includes vent openings 274, 276, 278 which receive pins used in the molding process used to make housing 10. A vent passageway 280 extends upwardly from the neck 18 into space 250. Walls 212, 236, 244, 246 and 234 close off communication between the interior of neck 18 and chamber 250 except through the vent passageway 280.

Figure 21:
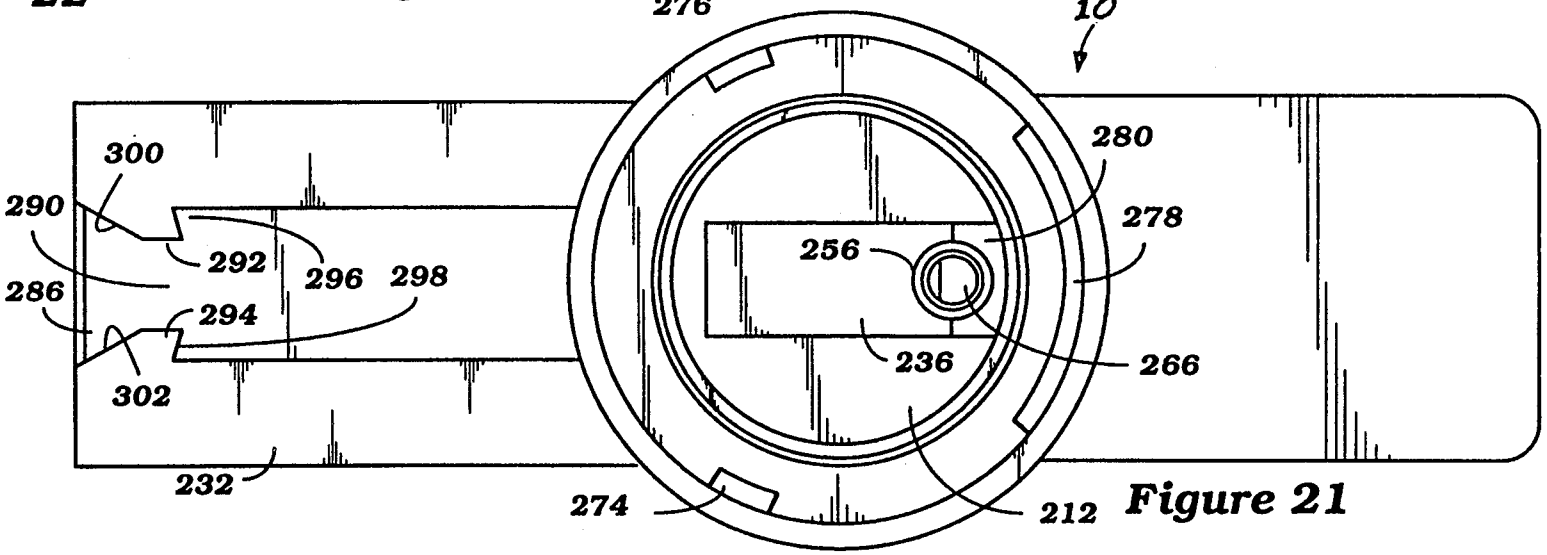
FIG. 21 is a bottom plan view of the housing part shown by FIG. 19, taken substantially from the position of line 21—21 in FIG. 19.

Walls 226, 228, 230, 232 form an inner space 282 within housing part 224 that has an open front end 284. A chamfer 286 may be provided at the front ends of walls 226, 228, 230, 232, about the entrance to chamber 282. As best shown by FIG. 21, lower wall 232 includes a longitudinal slot 288, extending forwardly from the upper end of neck 18. At the forward end of housing 224 there is a reduced width entrance 290 leading into the slot 288. This entrance 290 is formed by and between wall parts 292, 294. Inwardly of entrance 290, the wall parts 292, 294 include stop surfaces 296, 298 which correspond to stop surfaces 152, 154 on forward housing 12. Converging cam surfaces 300, 302 are formed at the forward ends of wall parts 292, 294.

Main housing 10 (FIG. 19) and inlet valve housing 156 (FIG. 15) together form a fixed housing part. Forward housing 12 is a movable housing part. In preferred form it includes trigger 14 and nozzle 16. The fixed housing part and the movable housing part together define a variable volume pump chamber between them. A compression spring 304 (FIG. 37) is positioned between the fixed housing part and the movable housing part. Compression spring 304 normally biases the movable housing part away from the fixed housing part. As will hereinafter be explained, a pull on the trigger 14 moves the movable housing part towards the fixed housing part and against the force of the compression spring 304. The spring 304 contracts and allows the movement to occur. The compressed spring 304 moves the movable housing part away from the fixed housing part when the pull on the trigger 14 is released.

The trigger sprayer also includes a draw tube 306 (FIG. 38). The upper end of the draw tube 306 fits within socket 260 (FIG. 19). Draw tube 306 includes a longitudinal center passageways 308 which communicates with inlet passageways 262, 264. The assembly of the trigger sprayer will now be described. Firstly, the draw tube 306 is positioned within the socket 260. The fit may be an interference fit or the two parts can be glued together. Next, the inlet valve housing 156 (FIG. 15) is inserted into the main housing 10 (FIG. 19). The seal section 162 is moved into the space 250. Seal section 162 is slightly larger in diameter at Seal 163 than the interior diameter of chamber 250. Thus, there is an interference fit between seal section seal lip 163 and the wall surface 252 of chamber 250. The seal lip 163 becomes deformed slightly as the seal section 162 is moved into the chamber 250. Inlet valve housing 156 is moved endwise until tubular tongue 176 enters into socket 266 and tubular tongue 272 enters into annular groove 178 (FIG. 25).

It is expected that the parts of the pump sprayer will be assembled by the use of high speed automatic machinery. This machinery will insert inlet valve housing 156 into the chamber 250 and make the plug together connection between tongue 176 and socket 266 and between tongue 272 and socket 178. The assembly machinery will also exert an inward push on valve plug 184, sufficient to break the frangible section 196 and force valve plug 184 rearwardly past the stop lugs 198, 200. A push exerted by the assembly machinery will shear the frangible section 196 and then push the valve plug 184 rearwardly. In the process, valve plug 184 will be squeezed between stop lugs 198, 200. There is enough resiliency in the valve plug 184 and the stop lugs 198, 200 to allow a snap movement of the valve plug 184 past the stop lugs 198, 200. Once valve plug 184 has passed the stop lugs 198, 200, end surface 194 confronts stop surfaces 202, 204. The valve plug 184 is now free to only move back and forth axially between inlet valve seat 268 and stop surfaces 202, 204. Upon assembly, the parts occupy the position shown in FIG. 25.

Figure 22:
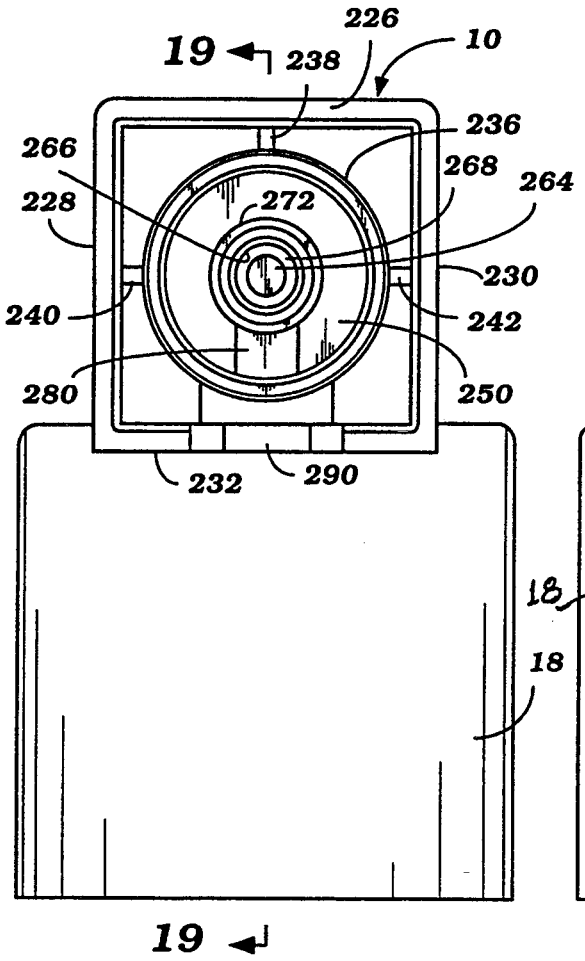
FIG. 22 is an end view of the housing part shown in FIGS. 19–21, taken substantially from the position shown by line 22—22 in FIG. 20.
Figure 23:
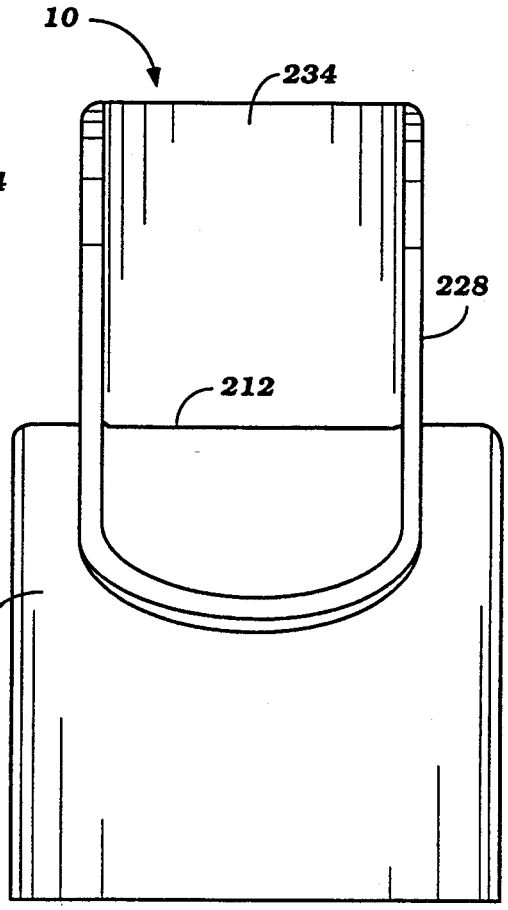
FIG. 23 is an opposite end elevational view of the housing part shown in FIGS. 19–22, taken substantially from the position indicated by line 23—23 in FIG. 20.

Next, spring 304 is inserted through front end 284, into space 310. The rear end of spring 304 is against the forward ends of webs 238, 240, 242, 244, 246 (FIG. 22). The forward end of tubular wall 236 fits loosely within the interior of spring 304. Next, the tubular portion 72 of forward housing 12 is inserted into housing 10, through end 284. Forward housing 12 is moved rearwardly until housing parts 292, 294 (FIG. 21) enter the slots 128, 130. Forward housing 12 is moved further towards the fixed housing part 10, to move the region between side surfaces 136, 138 (FIG. 12) through the entrance 290, past the wall sections 292, 294, and into the slot 288. Cam surfaces 300, 302 cam the forward housing through the entrance 290, past the housing parts 292, 294. Once the housing parts 292, 294 have been cleared, the stop surfaces 152, 154 above web 142 are positioned to confront stop surfaces 296, 298 on housing parts 292, 294 (FIG. 21). Spring 304 biases the forward housing portion 12 forwardly to place stop surfaces 152, 154 into contact with the stop surfaces 296, 298. This establishes the at rest or static position of the trigger sprayer. As can be seen from FIG. 20, a rearward pull on trigger 14 will move the forward housing 12 rearwardly, through slot 288.

Nozzle 16 is connected to forward housing 12 either prior to or after insertion of forward housing 12 into housing 10. Connection of nozzle 16 to the forward end of forward housing 12 is another snap-in operation. The rear section 26 of nozzle 16 (FIG. 8) is moved endwise into space 82 (FIG. 11). Nozzle 16 is moved rearwardly to move cam surface 58 against cam surfaces 85. Nozzle 16 is pushed rearwardly to snap the flange 54 past the lugs 83, to place radial surface 56 behind radial surfaces 87 (FIG. 25*a*). Nozzle 16 is free to rotate relative to housing part 12 an angular amount X (FIG. 9). An arcuate slot 17 is formed in nozzle 16. Slot 17 has opposite ends 19, 21. When nozzle 16 is installed, the tongue 150 (FIG. 11) is located within slot 17. Nozzle 16 can be rotated in one direction until end 19 contacts tongue 150. It can be rotated in the opposite direction until end 21 contacts tongue 150. This rotation is for the purpose of moving channel 97 (FIG. 11) into (FIG. 27) and out from (FIG. 28) alignment with channel 64 (FIG. 8). This procedure and its purpose is hereinafter explained in some detail.

Installation of forward housing 12 into housing 10 includes movement of tubular member 72 (FIG. 11) into the space 250 (FIG. 19), in the region surrounding inlet valve housing 156 (FIG. 15). When the parts are assembled, seal lip 167 makes an interference fit with surface 73 (FIG. 25). Contact of the sealing lip 167 with the surface 73 causes a radial inward deformation of the sealing lip 167, storing energy in part 166. This stored energy urges the sealing lip 167 radially outward into tight sealing engagement with surface 73. This is the same thing that happens at the rear end of inlet valve housing 156. Seal part 162 stores energy when it is compressed and it urges sealing lip 163 into tight sealing engagement with the surface 252.

The neck 18 is thread connected to the upper end portion 20 of bottle 22, as shown in FIGS. 35 and 36. Bottle 22 includes an upper end lip 310 that includes a cylindrical inner surface 312. The diameter of this inner surface 312 is slightly smaller than the diameter of cylindrical region 218 on flange 214 (FIG. 19). The bottle neck 20 includes an annular surface 314 at its base. Neck 18 includes an internal annular surface 316 which is slightly smaller in diameter than the base surface 314. When the neck 18 and bottle 22 are screwed together, the tapered surface 216 on flange 214 enters through the top opening in the bottle 22. This tapered surface 216 guides the cylindrical surface 218 into an interference fit with the lip surface 312. The air vent passageway 280 is located inside this fit. At the same time, the lower internal surface 316 on the neck 18 is moved into an interference fit with the base surface 314 on the bottle neck 20. The manufacturing pin openings 274, 276, 278 are located outside of this fit. For that reason, there can be no liquid leakage out through openings 274, 276, 278.

The operation of the liquid sprayer will now be described. Firstly, nozzle 16 is moved to a "spray" or "on" position (FIG. 27). This involves rotating nozzle 16 relative to parts 78, 102. As explained above, tongue 150 projects forwardly from housing section 70, into an arcuate groove 17 formed in the lower part of nozzle 16 (FIGS. 8 and 9). Nozzle 16 is rotatable in a first direction until end stop 19 contacts tongue 150, and is rotatable in the opposite direction until stop 21 contacts tongue 150. When nozzle 16 is in a "spray" or "on" position, passageway part 64, formed in member 26, is in axial alignment with passageway part 97, in part 102. This communicates pump chamber 318 with swirl chamber 320 (FIG. 30) formed by and between nozzle walls 42, 48 and pin 99.

When outlet wall 42 is moved forwardly into a spaced relationship with closure surface 103 (FIG. 30), there is a liquid flow path from passageway section 97, to and through the tangential passageways 66, 68, into and through annular chamber 320, and from annular chamber 320 to and through the outlet opening 46. When outlet wall 42 is in a position with outlet valve seat 47 against closure surface 103, there is no flow of liquid from chamber 320 to the outlet opening 46. Outlet opening 46 is closed. The outlet valve is in a closed position.

In preferred form, neck 20 of bottle 22 includes a finger rest 322. Let it be assumed that a user grasps the bottle 22 in his/her right hand. The index and middle fingers are placed in the recesses 132, 134, respectively, on trigger 14, and the ring finger is rested on bottle portion 322. Initially, the sprayer is in the position shown by FIG. 25. Let it be assumed that there is no liquid in pump chamber 318. The user pulls rearwardly on trigger 14, moving the movable housing part 12 rearwardly towards the fixed housing part 10. Seal member 162 forms a rear closure for the pump chamber 318, in the region between inlet valve housing 156 and tubular wall Air trapped in pump chamber 318 acts on valve plug 184, moving it rearwardly into a position with its closure surface 187 into seated engagement with inlet valve seat 268. The air trapped in pump chamber 318 also exerts a force on flex wall 36, thereby moving outlet wall 42 forwardly from pin 99, into an outlet opening position that is shown in FIG. 30. The rearward movement of housing part 12 towards housing part 10 moves axially member 106 into the space formed by inlet valve housing section 168. At the same time, section 168 is moved relatively into annular chamber 108. The presence of member 106 within the interior of tubular section 168, and the presence of tubular section 168 within chamber 108, substantially reduces the volume of the pump chamber 318 when the parts 10, 12 are moved relatively together, as shown in FIG. 26. Following a squeeze on trigger 14, to move housing part 12 rearwardly towards housing part 10, as shown in FIG. 26, the finger pressure on trigger 14 is released. This allows spring 304 to move housing part 12, 14 forwardly, away from housing part 10. As this movement occurs, the volume of pump chamber 318 increases, creating a suction within pump chamber 318. This suction allows the natural resiliency of flex wall 36 to move outlet valve seat 47 into contact with closure surface 103, to in that manner close the outlet valve. The suction also acts on valve plug 184, pulling it forwardly into a position with its end 190 against the stop surfaces 202, 204 of the stop lugs 198, 200 (FIG. 34). This moves closure surface 187 away from inlet valve seat 268, opening a liquid flow avenue from inlet passageway 264, through a space formed by and between closure surface 187 and inlet valve seat 268, then into an annular space surrounding valve plug 184 and leading into the interior of tubular section 168. The suction pulls liquid out from the bottle 22, upwardly through the draw tube 306, through inlet passageways 278, 264, around the valve plug 184, into the interior of tubular member 168, and then into chamber 108. Owing to the nesting of member 106 into tubular section 168, and tubular section 168 into chamber 108, the suction developed within pump chamber 318, and in response to a forward movement of housing part 12 relative to housing part 10, is relatively strong. It is believed that in most cases the first pull and release on trigger 14 will fill the pump chamber 318. When pump chamber 318 is full of liquid, a pull on the trigger 14 will close the inlet valve 184, 268, open the outlet valve 47, 103, and force liquid out through the outlet opening 46. Reduction of the volume of pump chamber 318 will force the liquid in pump chamber 318 out through passageway sections 64, 97, then through tangential passageways 66, 68, into swirl chamber 320, the liquid will travel a helical path in chamber 320 and will then move through the path formed by and between outlet valve seat 47 and closure surface 103, and will then move out through outlet opening 46 in the form of a spray. Each release of the trigger 14 will cause liquid to be drawn into pump chamber 318, and each pull on the trigger 14 will cause the delivery of a spray out through outlet opening 46.

Each pull on trigger 14 will move finger 118 against seal member 162. This moves a portion of seal lip 163 away from surface 252, whereupon venting is provided past the unseated valve member 162. The deflection of seal 162 connects chamber 250, forwardly of seal 162, with vent passageway 280 and the interior of the bottle 22.

When the user is done spraying, the nozzle 16 is rotated to move passageway section 64 out of alignment or liquid communication with passageway section 97. This creates a substantially liquid type seal between the cylindrical outer surface of wall 102 and the cylindrical inner surface of nozzle part 26. At the same time, outlet valve seat 47 will be against closure surface 103. These surfaces 47, 103 are also forced together by flex wall 36 except when the pump chamber is pressurized. They are forced together regardless of the position of sections 64 and 97.

FIGS. 39–43 disclose additional embodiments of the flex wall. In FIGS. 39 and 40, the flex wall is shown to have a relatively thin, substantially planar diaphragm, attached at its outer periphery to the nozzle body at 326, and attached at its inner periphery to nozzle wall 42, at 328. Diaphragm 36′ includes a plurality (e.g. eight) of stiffening ribs 330 which are attached to an annular central zone of the diaphragm 36′, but not to the peripheral portions of the diaphragm 36′. The ribs 330 permit but limit the flexure of diaphragm 324.

In FIG. 39, the portion of nozzle 16', located radially outwardly of diaphragm 324 has been omitted, except that the front end envelope of the nozzle 16' is shown by a broken line 332.

FIG. 41 shows a nozzle 16" having a flex wall 36" that is formed of circumferential corrugations. Flex wall 36" has an outer periphery that is connected to the nozzle body at 334 and an inner periphery that is connected to wall 42 at 336.

Between regions 334, 336 the flex wall 36" may include three corrugations 338, 340, 342. Corrugations 338, 342 includes forwardly directed ridges and rearwardly directed valleys. Corrugation 340 includes a forwardly directed valley and a rearwardly directed ridge. This construction of flex wall 36' provides a controlled amount of flucture.

Referring to FIGS. 42 and 43, in this embodiment the flex wall 36''' includes a substantially planar diaphragm 344 that is connected at its outer periphery 346 to the nozzle body and at its inner periphery 348 to the outlet wall 42'''. In this embodiment, the forward end portion 98' extends forwardly beyond pin 99, and has a forward end surface 350 that is closely adjacent diaphragm 344. The small axial gap between surface 350 and diaphragm 344, and the fit of pin 99 within tubular wall 48, controls the flexure of the flex wall 36'''. In this embodiment, a single passageway 352 extends through member 98', from passageway section 97 to an annular space which surrounds tubular wall 48. Liquid flow is from the pump chamber 318, through passageway section 64, then through passageway section 94, and then through radial passage 352, into this annular space, and then through the ports 66, and ultimately to the outlet opening 46.

FIGS. 44 and 45 disclose a foam making attachment for a nozzle 354 which is basically like nozzle 16 but includes a different front end tubular portion 356. Front end tubular portion 356 is tubular and includes a cylindrical inner surface 358. Tubular portion 356 is connected to nozzle portion 26 by a radial wall 360. Radial wall 360 includes a forwardly directed radial surface 362 that is perpendicular to surface 358. Tubular portion 356 includes diametrically opposed radial openings 364, 366.

The foam former is an insert 368 for the nozzle 354. Insert 368 includes a radial rear wall 370, a tubular wall 372 that projects forwardly from wall 370, a tubular rearward extension or wall 374 which projects rearwardly from wall 370, and a forward conical nozzle 376 which projects forwardly from a central portion of wall 370. Tubular wall 372 is sized to snugly fit within a front end cavity in nozzle 354, formed by cylindrical surface 358 and radial surface 362. Wall 370 has a circular periphery 378 that is equal in diameter to the outside surface of tubular wall 372, except that it includes a pair of radial lock lugs 380, 382. Lock lugs 380, 382 include rearwardly directed cam surfaces 384, 386 and forwardly directed lock surfaces 388, 390. When insert 368 is pushed into the front end cavity of the nozzle 354, the cam surfaces 384, 386 will contact inner surface portions of the tubular wall 356. There is enough give in the material to permit movement of the insert 368 into the cavity. About the time rear surface 392 of wall 370 reaches front surface 362 of wall 360, the lock lugs 380, 382 snap into the openings 364, 366. The lock surfaces 388, 390 engage forward radial surfaces 394, 396.

Foam nozzle wall 374 extends into annular space 398. An outer annular space 398 is formed radially between wall 341 and wall 374. An inner annular space 400 is formed radially between spray nozzle portion 40 and foam nozzle wall 374. Spray nozzle wall 374 includes a rear surface for a tube that is spaced axially forward from flex wall 36. A plurality of air openings (e.g. four) 404, are formed in wall 370, immediately about the base of radial wall 360 and the base of tubular wall 374. The interior of foam nozzle 376 includes a plurality of axial grooves 406, one for each air passageway 400. At their rear ends, the grooves 406 communicate with annular space 400. At their front ends, the grooves 406 communicate with a central circular opening 408 in the foam nozzle 376. In use, ambient air can enter through openings 404 into annular space 398, and then into annular space 400, and then into the interior of nozzle 376, including axial passageways 406 and outlet opening 408. The liquid sprayer is operated as described above, to deliver a liquid to and through the outlet opening 46. When the foam forming insert 368 is used, the liquid spray that is delivered through outlet opening 46 is constricted by the foam nozzle 376. The liquid spray induces ambient airflow through the openings 404, into annular regions 368, 400, and into the axial groove regions 406 of the foam nozzle 376. There is an add mixture of the air to the liquid, and a constriction of the mixture that creates a foam. The foam is discharged through outlet 408.

FIGS. 46 and 47 disclose a modified construction of the spring which is interposed between the movable housing part 12 and the fixed housing part 10. In this embodiment, the spring 410 is a leaf spring. It includes a forward section 412 that is embedded in the trigger 14. A second section 414 extends rearwardly and downwardly from section 412, to the lower end of a third section 416. Section 416 extends rearwardly and upwardly from section 414 to a fourth section 418. Section 418 is generally perpendicular to the direction of movement of housing section 12, during operation of the liquid sprayer. Section 418 rests against an upper surface portion 420 of neck 18. Trigger 14 is formed by injection molding. Spring section 412 is embedded in the trigger 14 while trigger 14 is being formed. FIG. 46 shows the static position of spring 410. In this position, there is an about 60 degree angle formed between spring sections 414 and 416. When trigger 14 is pulled rearwardly, the spring sections 414, 416 move together, reducing the angle Y in the process. This stores energy in the spring sections 414, 416. When a pull on the trigger 54 is released, this stored energy moves the movable housing part 12 forwardly relative to fixed housing part 10, to place the parts 12, 10 back into their static positions (FIG. 45, 46).

FIGS. 48 and 49 show a modified construction of the inlet valve housing 156'. Inlet valve housing 156' is constructed to be used with the fixed housing section 10 shown by FIG. 19. Seal member 162 is movable into annular space 250, with seal edge 163 in a tight interference fit engagement with surface 252. Inlet valve housing 156' is moved rearwardly within a housing section 10 until tongue 272 is within groove 178 and tongue 176 is within the front end socket formed within the confines of tongue 272. A difference is, inlet valve seat 268 is not used. Also, there are four stop lugs 422 and they are positioned adjacent the front end of tubular section 424. Lugs 422 include front end cam surfaces 426 and rear end cam surfaces 428. A frustoconical valve seat is formed at 430. In this embodiment, the valve plug is a spherical member or ball 432. When ball 432 is positioned rearwardly against inlet valve seat 430, the inlet valve is closed. When ball 432 is positioned forwardly against stop lugs 422, the inlet valve is open. The ball 432 is spaced forwardly of the inlet valve seat 430. Liquid flows between seat 430 and ball 432, into and through an annular space 434 that surrounds the ball 432. In this embodiment, a central passageway 436, extending through tubular section 424, connects passageway 264 in stem 248 with the inlet valve 430, 432. When valve housing 156' is used, the axial member 106 (FIG. 25) is shortened or omitted. Tubular portion 424 becomes the member which fills up the pump chamber 318, in place of member 106.

Several embodiments of the trigger sprayer of this invention have been disclosed and described. It is to be recognized that the scope of protection is not to be limited by these embodiments, but rather is to be established by the claims which follow, construed in accordance with established rules of patent claim construction, including use of the doctrine of equivalents.

What is claimed is:

1. In a liquid sprayer of a type comprising a fixed housing part and a movable housing part together defining a variable volume pump chamber between them, wherein said fixed housing part includes a liquid inlet passageway for delivering liquid from a reservoir into the pump chamber, and an inlet valve, and said movable housing part includes a spray forming outlet and an outlet valve, wherein movement of the movable housing part towards the fixed housing part decreases the volume of the pump chamber, closes the inlet valve, opens the outlet valve, and forces liquid out from the pump chamber through the spray forming outlet, and wherein movement of the movable housing part away from the fixed housing part increases the volume of the pump chamber, closes the outlet valve, opens the inlet valve, and draws liquid through said inlet passageway into the pump chamber, the improvement characterized by;

said inlet passageway including an annular sidewall, a forward end, and an internal valve plug socket which opens towards the pump chamber, said socket including an annular base and an annular inlet valve seat at said base, said movable housing part including an axially movable annular wall surrounding at least a forward portion of the annular sidewall of the inlet passageway, said annular wall forming a sidewall of the pump chamber;

a seal between said annular wall and said annular side wall of said inlet passageway, said inlet valve including an axially elongated valve plug within said inlet passageway, said valve plug having a closure, first end directed towards the inlet valve seat, and an opposite, second end;

said inlet passageway including an internal valve plug stop spaced axially from the inlet valve seat and confronting the second end of the valve plug, said valve plug stop being spaced rearwardly from the forward end of said inlet passageway, wherein when the inlet valve is closed the first end of the valve plug is against the inlet valve seat, and the second end of the valve plug is spaced axially from the valve plug stop, and wherein when the inlet valve is open the second end of the valve plug is against the valve plug stop, the first end of the valve plug is spaced axially from the inlet valve seat, and a liquid flow path is formed in the valve plug socket around the valve plug, through which liquid flows into the pump chamber.

2. The liquid sprayer improvement of claim 1, wherein said valve plug stop comprises at least one stop lug spaced axially from said inlet valve seat, said second end of the valve plug being against the stop lug when the inlet valve is open.

3. In a liquid sprayer of a type comprising a fixed housing part and a movable housing part together defining a variable volume pump chamber between them, wherein said fixed housing part includes a liquid inlet passageway for delivering liquid from a reservoir into the pump chamber, and an inlet valve, and said movable housing part includes a spray forming outlet and an outlet valve, wherein movement of the movable housing part towards the fixed housing part decreases the volume of the pump chamber, and closes the inlet valve, and opens the outlet valve, and forces liquid out from the pump chamber through the spray forming outlet, and wherein movement of the movable housing part away from the fixed housing part increases the volume of the pump chamber, and closes the outlet valve, opens the inlet valve, and draws liquid through said inlet passageway into the pump chamber, the improvement characterized by;

said inlet passageway including a valve plug socket which opens towards the pump chamber, said socket including an annular base and an annular inlet valve seat at said base, said inlet valve including an axially elongated valve plug having a closed, convex first end directed towards the inlet valve seat, and an opposite, second end, having an end wall;

said fixed housing part including a valve plug stop spaced axially from the inlet valve seat and confronting the second end of the valve plug, wherein when the inlet valve is closed the closure end of the valve plug is against the inlet valve seat, the second end of the valve plug is spaced axially from the valve plug stop, wherein when the inlet valve is open the second end of the valve plug is against the valve plug stop, the closure end portion of the valve plug is spaced axially from the inlet valve seat, and a liquid flow path is formed in the valve plug socket around the valve plug, through which liquid flows into the pump chamber; and wherein the movable housing part includes an outlet member having an axial outlet opening at its center surrounded by an annular outlet valve seat, said outlet valve including said outlet member and a pin positioned axially inwardly of the outlet opening, said pin including a closure surface confronting the outlet valve seat, said outlet member being resilient and having a static first position in which said outlet valve seat is in contact with the closure surface on the pin and the outlet opening is closed, and said outlet member being movable by fluid pressure in the pump chamber, axially away from the pin, into a second position in which the outlet valve seat is spaced from the closure surface and a fluid passageway is formed by and between the outlet valve seat and the closure surface, said outlet valve being closed when the outlet member is in said first position and being open when the outlet member is in said second position.

4. The liquid sprayer improvement of claim 3, wherein said outlet member includes an annular wall projecting axially rearwardly, into a position surrounding the pin, said outlet member and said pin together defining a swirl chamber, and said movable housing part including at least one passageway leading from the pump chamber generally tangentially into the swirl chamber.

5. A liquid sprayer, comprising:

a fixed housing part;

a movable housing part;

said fixed and movable housing parts together defining a variable volume pump chamber between them;

said movable housing part including a spray forming outlet and an outlet valve;

said fixed housing part including an elongated stem having a longitudinal liquid inlet passageway for delivering liquid from a reservoir into the pump chamber, said inlet passageway including a valve plug socket opening towards the pump chamber, said valve plug socket including an annular base and an annular inlet valve seat at said base;

said fixed housing part also including a tubular member that is formed separate from said stem, said tubular member having a first end portion that engages said stem and a second end portion that extends axially outwardly from said stem, said second end portion of the tubular member being formed to include radially inwardly projecting stop lugs spaced axially from the valve plug socket;

a valve plug that is initially positioned within the second end portion of the tubular member, axially outwardly from said stop lugs, said valve plug having a closure end facing the valve plug socket, and a second opposite end;

a frangible section initially connecting said valve plug to the second end portion of the tubular member, said frangible section being breakable in response to a push on the valve plug, and said valve plug being axially moveable by a push, through the second end portion of the tubular member, beyond the stop lugs, into a position between the inlet valve seat and the stop lugs;

said valve plug and said valve plug socket together forming an inlet valve for the pump chamber;

said second end of the valve plug confronting the stop lugs once the valve plug has been moved past the plugs;

wherein a subsequent movement of the movable housing part towards the fixed housing part, with liquid in the pump chamber, causes the liquid to push the valve plug into the valve plug socket and move the closure end of the valve plug against the inlet valve seat, while at the same time opening the outlet valve and forcing liquid out from the pump chamber through the spray forming outlet;

wherein when the closure end of the valve plug is against the inlet valve seat, the second end of the valve is spaced axially from the stop lugs;

wherein a movement of the movable housing part away from the fixed housing part closes the outlet valve, opens the inlet valve and draws liquid through the inlet passageway into the pump chamber; and wherein when the inlet valve is open, the second end of the valve plug is against the stop lugs, the closure end portion of the valve plug is spaced axially from the inlet valve seat, and a liquid flow path is formed in the valve plug socket around the valve plug, through which liquid flows into the pump chamber.

6. The liquid sprayer of claim 5, wherein the movable housing part includes an outlet member having an axial outlet opening at its center surrounded by a circular outlet valve seat, said outlet valve including said outlet member and a pin located axially of the outlet opening, said pin including a closure surface confronting the outlet valve seat, said outlet member being axially resilient and having a static first position in which said outlet valve seat is in contact with the closure surface on the pin and the outlet opening is closed, and said outlet member being movable by fluid pressure in the pump chamber away from the outlet valve pin into a second position in which the outlet valve seat is spaced from the closure surface and a fluid passageway is formed by and between the outlet valve seat and the closure surface, said outlet valve being closed when the outlet member is in said first position and being open when the end wall is in said second position.

7. The liquid sprayer of claim 6, wherein said outlet member includes an annular wall projecting axially inwardly into a position surrounding the pin, said outlet member and said pin together defining a swirl chamber, and said movable housing part including at least one passageway leading from the pump chamber into the swirl chamber.

8. A liquid sprayer of claim 5, wherein said movable housing part includes an outer end portion and a tubular sidewall extending axially inwardly from said outer end portion and surrounding the axial member, said tubular sidewall and said axial member together defining an annular space between them, and wherein when the movable housing part is moved towards the fixed housing part the axial member is moved into the second end portion of the tubular housing and the second end portion of the tubular housing is moved into the annular space.

9. The liquid sprayer of claim 8, wherein the movable housing part includes an outlet member having an axial outlet opening at its center surrounded by a circular outlet valve seat, said outlet valve including said outlet member and a pin located axially inwardly of the outlet opening, said pin including a closure surface confronting the outlet valve seat, said outlet member being axially resilient and having a static first position in which said outlet valve seat is in contact with the closure surface on the pin and the outlet opening is closed, and said outlet member being movable by fluid pressure in the pump chamber away from the outlet valve pin into a second position in which the outlet valve seat is spaced from the closure surface and a fluid passageway is formed by and between the outlet valve seat and the closure surface, said outlet valve being closed when the outlet member is in said first position and being open when the outlet member is in said second position.

10. The liquid sprayer improvement of claim 9, wherein said outlet member includes an annular wall projecting axially inwardly into a position surrounding the pin, said end wall, said outlet member and said pin together defining a swirl chamber, and said movable housing part including at least one passageway leading from the pump chamber into the swirl chamber.

11. In a liquid sprayer of a type comprising a fixed housing part and a movable housing part together defining a variable volume pump chamber, wherein said fixed housing part includes an elongated tubular stem including a liquid inlet passageway for delivering a liquid into the pump chamber, an inlet valve, and a tubular wall surrounding said tubular stem, with an annular chamber being formed by and radially between the tubular wall and the tubular stem, wherein said movable housing part includes an outlet opening and an outlet valve between the pump chamber and the outlet opening, wherein movement of the movable housing part towards the fixed housing part decreases the volume of the pump chamber, and closes the inlet valve, and opens the outlet valve, and forces liquid out from the pump chamber through the outlet opening, and wherein movement of the movable housing part away from the fixed housing part increases the volume of the pump chamber, and closes the outlet valve, and opens the inlet valve, and draws liquid from the inlet passageway into the pump chamber, the improvement characterized by:

said fixed housing part including an elongated, tubular inlet valve housing, having a rear end portion fittable into said annular chamber, about said tubular stem, said inlet valve housing also including radially inwardly projecting stop lugs;

said inlet valve including a forwardly directed valve seat spaced rearwardly from the stop lugs; and a valve plug positioned axially between said inlet valve seat and the stop lugs, said valve plug being movable back and forth axially between a rear position in which it is seated against the inlet valve seat, and the inlet valve is closed, and a forward position in which it is against the stop lugs, the inlet valve is open, and a liquid passageway is formed about the valve plug member.

12. The improvement of claim 11, wherein said inlet valve seat is formed within the tubular stem.

13. The improvement of claim 11, wherein the inlet valve seat is formed in the tubular inlet valve housing.

14. The improvement of claim 13, wherein the valve plug is a spherical ball.

15. The improvement of claim 11, wherein the valve plug is axially elongated and has a convex rear end and a generally radial front end.

16. The improvement of claim 11, wherein the rear end portion of the tubular inlet valve housing includes a seal forming edge that makes an interference fit seal with the tubular wall that surrounds the tubular stem.

17. The improvement of claim 16, wherein the movable housing part includes a tubular sidewall that is a sidewall of the pump chamber and which extends into said annular space, between the tubular wall surrounding the stem and the tubular inlet valve housing, said tubular inlet valve housing including a seal forming edge that makes a tight interference fit seal with the inside surface of said tubular sidewall, to form a seal between the tubular inlet valve housing and said tubular sidewall, said seal and said inlet valve constituting rear end closures for the pump chamber.

18. For use in a liquid sprayer, a tubular inlet valve housing, comprising:

a sidewall having first and second opposite ends and an interior space extending from the first end to the second end;

radially inwardly projecting stop lugs, projecting from said sidewall into said space, between the first and second ends;

a valve plug, in said space and including a closed first end, directed towards the second end of the inlet valve housing and including a closure surface, and a second end; and a frangible section initially connecting the closure plug to the tubular inlet valve housing, in a position forwardly of the stop lugs, wherein the second end of the valve plug has an outside diameter that is larger than a space between the stop lugs, wherein the frangible section can be severed by a push on the valve plug to separate the valve plug from the sidewall, and wherein the second end of the valve plug is dimensioned to be snap-fitted past the stop lugs.

19. The inlet valve housing of claim 18, wherein the second end of the valve plug includes sloping cam surfaces directed towards the stop lugs, said cam surfaces functioning to cam the valve plug past the stop lugs in response to an endwise push on the valve plug, following breakage of the frangible section.

20. The improvement of claim 18, wherein the stop lugs include sloping cam surfaces directed towards the second end of the valve plug, said sloping cam surfaces serving to cam the valve plug past the stop lugs in response to an endwise movement on the valve plug, following breakage of the frangible section.

21. The improvement of claim 20, wherein the second end of the valve plug includes sloping cam surfaces facing the sloping cam surfaces on the stop lugs, said cam surfaces on the stop lugs and the cam surface on the second end of the valve plug functioning to cam the valve plug past the stop lugs, in response to an endwise push on the valve plug, following breakage of the frangible section.

22. For use in a liquid sprayer, a tubular inlet valve housing, comprising:

a sidewall having first and second ends and an interior space extending from the first end to the second end;

an annular inlet valve seat in said space formed as a part of the sidewall, said inlet valve seat being directed towards the first end;

stop lugs spaced axially towards said first end from the inlet valve seat, said stop lugs projecting radially inwardly from the sidewall;

said inlet valve seat and said stop lugs forming between them a space for receiving a valve plug which is movable axially between a first position in which it is against the inlet valve seat and is spaced axially from the stop lugs, and a second position in which it is against the stop lugs and is spaced axially from the inlet valve seat;

a first seal forming edge at the second end of the inlet valve housing, adapted to make a tight interference fit seal with a surrounding tubular wall, to form a seal between the inlet valve housing and the surrounding tubular wall; and a second seal forming edge spaced forwardly of the first seal forming edge, said second seal forming edge being adapted to make a tight interference fit seal with the inside surface of a second tubular wall, to form a seal between the tubular inlet valve housing and the second tubular wall.

23. The inlet valve housing of claim 22, said housing having a large diameter rear section and a small diameter front section, and said second seal forming edge being located generally where the two sections meet.

24. The inlet valve housing of claim 23, wherein the large diameter rear section has a cylindrical inner sidewall surface, and said housing includes an annular joint tongue in said space, generally where the two sections of the housing meet, said joint tongue extending axially in the space towards the second end of the housing, and said joint tongue being surrounded by an annular joint groove.

25. In a liquid sprayer of a type comprising a fixed housing part and a movable housing part together defining a variable volume pump chamber between them, wherein said fixed housing part includes a liquid inlet passageway for delivering a liquid into the pump chamber, and an inlet valve between said passageway and the pump chamber, wherein said movable housing part includes an outlet opening and an outlet valve between the pump chamber and the outlet opening, wherein movement of the movable housing part towards the fixed housing part decreases the volume of the pump chamber, and closes the inlet valve, and opens the outlet valve, and forces liquid out from the pump chamber through the outlet opening, and wherein movement of the movable housing part away from the fixed housing part increases the volume of the pump chamber, and closes the outlet valve, and opens the inlet valve, and draws liquid from the inlet passageway into the pump chamber, the improvement characterized by:

said fixed housing part having an inlet region including a forwardly facing, inlet valve seat surrounding the liquid inlet passageway, radially inwardly directed stop lugs spaced axially forwardly from the inlet valve seat, and a valve plug positioned between the stop lugs and the inlet valve seat, said valve plug being movable between a first position in which it is seated on the inlet valve seat, and closes the liquid inlet passageway, and is spaced from the stop lugs, and a second position in which it is against the stop lugs, is spaced from the inlet valve seat, and the liquid inlet passageway is open to permit liquid flow past the valve plug into the pump chamber;

said movable housing part comprising an elongated tubular sidewall forming a pump chamber sidewall, and a forward part forming a pump chamber front wall;

a seal sealing between the inlet region and the pump chamber sidewall, said seal constituting a rear end closure for the pump chamber;

said movable housing part including an outlet member positioned forwardly of the pump chamber front wall, said outlet member including an outlet orifice surrounded by a rearwardly directed outlet valve seat;

said pump chamber front wall including a forwardly facing pin having a closure surface confronting the outlet valve seat;

said movable housing part also including a flex wall section connected to the outlet member, said flex wall section normally holding the valve seat contiguous the closure surface on the pin, but permitting axial movement of the outlet member forwardly away from the pin, to create a liquid passage between the outlet valve seat and the closure surface; and an outlet passageway leading from the pump chamber to a region adjacent the outlet valve seat, the closure surface, and the flex wall section, wherein movement of the movable housing part towards the fixed housing part, when liquid is in the pump chamber, will move the valve plug into a seated position on the inlet valve seat, and will force liquid out from the pump chamber through the outlet passageway to the flex wall section, and will exert pressure on the flex wall section to force the outlet member forwardly, thereby moving the outlet valve seat away from the closure surface on the pin and permitting liquid flow between the outlet valve seat and the closure surface on the pin, to and through the outlet opening, and wherein a forward movement of the movable housing part away from the fixed housing part will cause a rearward movement of the flex wall section and the outlet member, to place the outlet valve seat against the closure surface on the pin, and will move the valve plug forwardly from the inlet valve seat, into a position against the stop lugs, thereby permitting liquid flow through the liquid inlet passageway into the pump chamber.

26. The improvement of claim 25, wherein the movable housing part includes a pump chamber space outwardly bounded by the pump chamber sidewall, and said fixed housing part includes a tubular portion which projects into said chamber space when the movable housing part is moved towards the fixed housing part, to substantially decrease the volume of such chamber space.

27. The improvement of claim 26, wherein said movable housing part includes an axial member projecting rearwardly from the pump chamber front wall, wherein said chamber space is annular and is formed by and radially between the pump chamber sidewall and said axial member, and wherein said tubular portion of the fixed housing part extends relatively into this annular chamber, and said axial member extends relatively into the tubular portion of the fixed housing part, when the movable housing part is moved towards the fixed housing part.

28. The improvement of claim 25, wherein the movable housing part includes a nozzle that is rotatable relative to the pump chamber front wall and pump chamber sidewall, said outlet member and said flex wall section being a part of the nozzle, and wherein the outlet passageway includes a first passageway section that is formed in the nozzle and a second passageway section that is formed in a said pump chamber wall, said nozzle being rotatable to move the two passageway sections between a first position in which the two passageway sections are in an alignment, and will allow liquid movement through the outlet passageway from the pump chamber to the outlet opening, and a second position in which the two passageway sections are out of alignment and liquid flow from the pump chamber through the outlet passageway is blocked.

29. The improvement of claim 28, wherein the flex wall section is annular and includes a first convex side and a second concave side.

30. The improvement of claim 29, wherein the movable housing part includes a pump chamber space outwardly bounded by the pump chamber sidewall, and said fixed housing part includes a tubular portion which projects into said chamber space, when the movable housing part is moved towards the fixed housing part, to substantially decrease the volume of such chamber space.

31. The improvement of claim 30, wherein said movable housing part includes an axial member projecting rearwardly from the pump chamber front wall, wherein said chamber space is annular and is formed by and radially between the pump chamber sidewall and said axial member, and wherein said tubular portion of the fixed housing part extends rearwardly into this annular chamber, and said axial member extends relatively into the tubular portion of the fixed housing part, when the movable housing part is moved towards the fixed housing part.

32. The improvement of claim 25, wherein the flex wall section includes an annular, generally planar diaphragm, disposed in a generally radial plane, said diaphragm having an outer peripheral connection to a portion of the movable housing part and an inner connection to the outlet member, and said diaphragm including stiffening ribs connected to the diaphragm, said stiffening ribs permitting but limiting flucture movement of the diaphragm.

33. The improvement of claim 25, wherein said flex wall section is composed of concentric corrugations, such corrugations permitting but limiting flucture of movement of the flex wall section.

34. The improvement of claim 25, wherein said flex wall section is a substantially planar diaphragm in a radial plane, having a rear surface directed towards the front wall of the pump chamber, said front wall of the pump chamber also being disposed in a substantially radial plane and being spaced axially from the diaphragm, said front wall including an annular socket and said outlet member including an annular wall which extends into said annular socket.

35. The improvement of claim 25, including a spring positioned between the movable housing part and the fixed housing part.

36. The improvement of claim 35, wherein the spring is a bent leaf spring having a first end connected to the movable housing part, a second end connected to the fixed housing part and a generally U-shaped center part interconnecting the two end parts.

37. In a liquid sprayer of a type comprising a fixed housing part and a movable housing part together defining a variable volume pump chamber between them, wherein said fixed housing part includes a liquid inlet passageway for delivering liquid from a reservoir into the pump chamber, and an inlet valve, and said movable housing part includes a spray forming outlet and an outlet valve, wherein movement of the movable housing part towards the fixed housing part decreases the volume of the pump chamber, and closes the inlet valve, and opens the outlet valve, and forces liquid out from the pump chamber through the spray forming outlet, and wherein movement of the movable housing part away from the fixed housing part increases the volume of the pump chamber, and closes the outlet valve, opens the inlet valve, and draws liquid through said inlet passageway into the pump chamber, the improvement characterized by:

said movable housing part including an annular radial wall surrounding the spray forming outlet, and an annular tubular wall connected to the radial wall and extending forwardly from the radial wall, said tubular wall and said radial wall defining a front end socket;

a foam forming insert comprising a body fittable into said socket, said body including a tubular center portion having a central passageway open at its front and rear, said passageway being in axial alignment with the spray forming outlet and converging from its rear to its front; and an ambient air path for introducing ambient air into the rear of the passageway.

38. The improvement of claim 37, wherein the body of the foam forming insert includes radially outwardly directing lugs, and the tubular sidewall of the socket includes recesses for receiving the lugs, said lugs being snap fittable into the recesses.

39. The improvement of claim 37, wherein the body of the foam forming insert includes axial openings surrounding the tubular center portion, such openings forming the ambient air paths.

40. The improvement of claim 39, wherein the body of the foam forming insert includes radially outwardly directing lugs, and the tubular sidewall of the socket includes recesses for receiving the lugs, said lugs being snap fittable into the recesses.

* * * * *